US012509853B2

(12) United States Patent
Shimizu et al.

(10) Patent No.: US 12,509,853 B2
(45) Date of Patent: Dec. 30, 2025

(54) COMPUTING DEVICE AND COMPUTING METHOD

(71) Applicant: KOMATSU LTD., Tokyo (JP)

(72) Inventors: Minoru Shimizu, Tokyo (JP); Shota Yamawaki, Tokyo (JP); Motoki Koyama, Tokyo (JP)

(73) Assignee: KOMATSU LTD., Tokyo (JP)

( * ) Notice: Subject to any disclaimer, the term of this patent is extended or adjusted under 35 U.S.C. 154(b) by 256 days.

(21) Appl. No.: 18/283,595

(22) PCT Filed: Jan. 24, 2022

(86) PCT No.: PCT/JP2022/002400
§ 371 (c)(1),
(2) Date: Sep. 22, 2023

(87) PCT Pub. No.: WO2022/209214
PCT Pub. Date: Oct. 6, 2022

(65) Prior Publication Data

US 2024/0167247 A1 May 23, 2024

(30) Foreign Application Priority Data

Mar. 31, 2021 (JP) ..... 2021-061390

(51) Int. Cl.
*E02F 9/20* (2006.01)
*E02F 9/26* (2006.01)

(52) U.S. Cl.
CPC ..... *E02F 9/2029* (2013.01); *E02F 9/265* (2013.01)

(58) Field of Classification Search
CPC ..... E02F 9/2029; E02F 9/265; E02F 9/264; E02F 9/2025; E02F 3/435; G01G 19/083; G01G 19/10; B60Y 2200/412; B60Y 2200/415
See application file for complete search history.

(56) References Cited

U.S. PATENT DOCUMENTS

| | | | | |
|---|---|---|---|---|
| 8,515,627 | B2 | 8/2013 | Marathe et al. | |
| 2018/0274210 | A1 | 9/2018 | Nishimura et al. | |
| 2020/0011031 | A1* | 1/2020 | Tomita | G01G 23/14 |

(Continued)

FOREIGN PATENT DOCUMENTS

| | | | |
|---|---|---|---|
| CN | 102914351 | A | 2/2013 |
| CN | 106225896 | A | 12/2016 |

(Continued)

*Primary Examiner* — Russell Frejd
(74) *Attorney, Agent, or Firm* — Faegre Drinker Biddle & Reath LLP

(57) ABSTRACT

A hydraulic excavator includes a vehicular body, a boom bottom pin supported by the vehicular body, a boom rotatably coupled to the vehicular body by the boom bottom pin, a boom top pin attached to a tip end of the boom, an arm rotatably coupled to the boom by the boom top pin, an arm top pin attached to a tip end of the arm, and a bucket rotatably coupled to the arm by the arm top pin. The computing device calculates a weight of a load conveyed by a work implement based on any two equilibrium equations of an equation of moment equilibrium around the boom bottom pin, an equation of moment equilibrium around the boom top pin, and an equation of moment equilibrium around the arm top pin.

17 Claims, 11 Drawing Sheets

(56) References Cited

U.S. PATENT DOCUMENTS

| | | | | |
|---|---|---|---|---|
| 2020/0095751 | A1* | 3/2020 | Nishimura | E02F 9/264 |
| 2020/0208373 | A1 | 7/2020 | Nakamura et al. | |
| 2022/0381008 | A1* | 12/2022 | Yamawaki | E02F 9/267 |
| 2022/0389688 | A1* | 12/2022 | Yamawaki | E02F 3/431 |

FOREIGN PATENT DOCUMENTS

| | | | |
|---|---|---|---|
| CN | 108291387 | A | 7/2018 |
| CN | 109440855 | A | 3/2019 |
| CN | 109680738 | A | 4/2019 |
| JP | H07-252091 | A | 10/1995 |
| JP | H10-245874 | A | 9/1998 |
| JP | 2019-157362 | A | 9/2019 |
| JP | 2020-164325 | A | 10/2020 |
| JP | 2020-165253 | A | 10/2020 |
| JP | 2021-021263 | A | 2/2021 |

* cited by examiner

COMPUTING DEVICE AND COMPUTING METHOD

TECHNICAL FIELD

The present disclosure relates to a computing device and a computing method to calculate a weight of a load conveyed by a work implement.

BACKGROUND ART

Japanese Patent Laying-Open No. 10-245874 (PTL 1) discloses a computing device that calculates a load weight in a bucket based on a condition for equilibrium of force around a bucket support shaft in a hydraulic excavator including the bucket.

CITATION LIST

Patent Literature

PTL 1: Japanese Patent Laying-Open No. 10-245874

SUMMARY OF INVENTION

Technical Problem

The literature describes experimentally finding a position of a center of gravity of a load in a bucket. The position of the center of gravity of the load in the bucket, however, is not necessarily constant. Therefore, it has been difficult to enhance accuracy of a load weight with a technique to calculate the load weight based on the experimentally found position of the center of gravity.

The present disclosure proposes a computing device capable of accurately calculating a weight of a load conveyed by a work implement.

Solution to Problem

According to one aspect of the present disclosure, a computing device in a work machine including a work implement, the computing device calculating a weight of a load conveyed by the work implement, is proposed. The work machine includes a vehicular body, a boom bottom pin supported by the vehicular body, a boom rotatably coupled to the vehicular body by the boom bottom pin, a boom top pin attached to a tip end of the boom, an arm rotatably coupled to the boom by the boom top pin, an arm top pin attached to a tip end of the arm, and an attachment rotatably coupled to the arm by the arm top pin. The computing device calculates the weight of the load based on any two equilibrium equations of an equation of moment equilibrium around the boom bottom pin, an equation of moment equilibrium around the boom top pin, and an equation of moment equilibrium around the arm top pin.

According to one aspect of the present disclosure, a computing device in a work machine including a work implement, the computing device calculating a weight of a load conveyed by the work implement, is proposed. The work machine includes a vehicular body, a boom bottom pin supported by the vehicular body, a boom rotatably coupled to the vehicular body by the boom bottom pin, a boom top pin attached to a tip end of the boom, an attachment rotatably coupled to the boom by the boom top pin, and a pivot member supported by the boom and being rotatable with respect to the boom together with the attachment. The computing device calculates the weight of the load based on two equilibrium equations of an equation of moment equilibrium around the boom bottom pin and an equation of moment equilibrium around a center of rotation of the pivot member.

According to one aspect of the present disclosure, a computing device of a work machine including a work implement, the computing device calculating a weight of a load conveyed by the work implement, is proposed. The work machine includes a vehicular body, a boom bottom pin supported by the vehicular body, a boom having one end rotatably coupled to the vehicular body by the boom bottom pin, a boom top pin attached to the other end of the boom, an arm having one end rotatably coupled to the other end of the boom by the boom top pin, an arm top pin attached to the other end of the arm, an attachment having one end rotatably coupled to the other end of the arm by the arm top pin, a boom hydraulic cylinder that drives the boom to rotationally operate, an arm hydraulic cylinder that drives the arm to rotationally operate, an attachment hydraulic cylinder that drives the attachment to rotationally operate, a pressure sensor, and a position sensor. The pressure sensor includes at least two sensors of a boom pressure sensor that is attached to the boom hydraulic cylinder and outputs hydraulic oil pressure information of the boom hydraulic cylinder, an arm pressure sensor that is attached to the arm hydraulic cylinder and outputs hydraulic oil pressure information of the arm hydraulic cylinder, and an attachment pressure sensor that is attached to the attachment hydraulic cylinder and outputs hydraulic oil pressure information of the attachment hydraulic cylinder. The position sensor includes a boom position sensor that outputs boom information for obtaining a position of the boom with respect to the vehicular body, an arm position sensor that outputs arm information for obtaining a position of the arm with respect to the boom, and an attachment position sensor that outputs attachment information for obtaining a position of the attachment with respect to the arm. The computing device calculates the weight of the load in conveyance of the load based on any two relational expressions of a first relational expression generated from the hydraulic oil pressure information of the boom hydraulic cylinder and the boom information, a second relational expression generated from the hydraulic oil pressure information of the arm hydraulic cylinder and the arm information, and a third relational expression generated from the hydraulic oil pressure information of the attachment hydraulic cylinder and the attachment information. The pressure sensor includes at least two sensors corresponding to the two relational expressions.

According to one aspect of the present disclosure, a computing method of calculating a weight of a load conveyed by a work implement, for a work machine including the work implement, is proposed. The work implement includes as members, a boom that pivots around a first center of rotation, an arm that pivots around a second center of rotation, and an attachment that pivots around a third center of rotation. The computing method includes processing below. First processing is to establish, for the members, relational expressions of a motion around any two centers of rotation of the first center of rotation, the second center of rotation, and the third center of rotation. Second processing is to obtain a weight and a position of a center of gravity of each of the members. Third processing is to obtain positions of the members in conveyance of the load. Fourth processing is to obtain thrust corresponding to the motion in the relational expressions. Fifth processing is to compute horizontal distances between the positions of the centers of gravity of the members in conveyance of the load and corresponding ones of the first center of rotation, the second center of rotation, and the third center of rotation based on the positions of the centers of gravity and the positions of the members, respectively. Sixth processing is to compute the weight of the load conveyed by the work implement based on the relational expressions, the obtained information, and the computed information.

Advantageous Effects of Invention

According to the computing device and the computing method according to the present disclosure, a weight of a load conveyed by a work implement can accurately be calculated.

DESCRIPTION OF EMBODIMENTS

Figure 1:
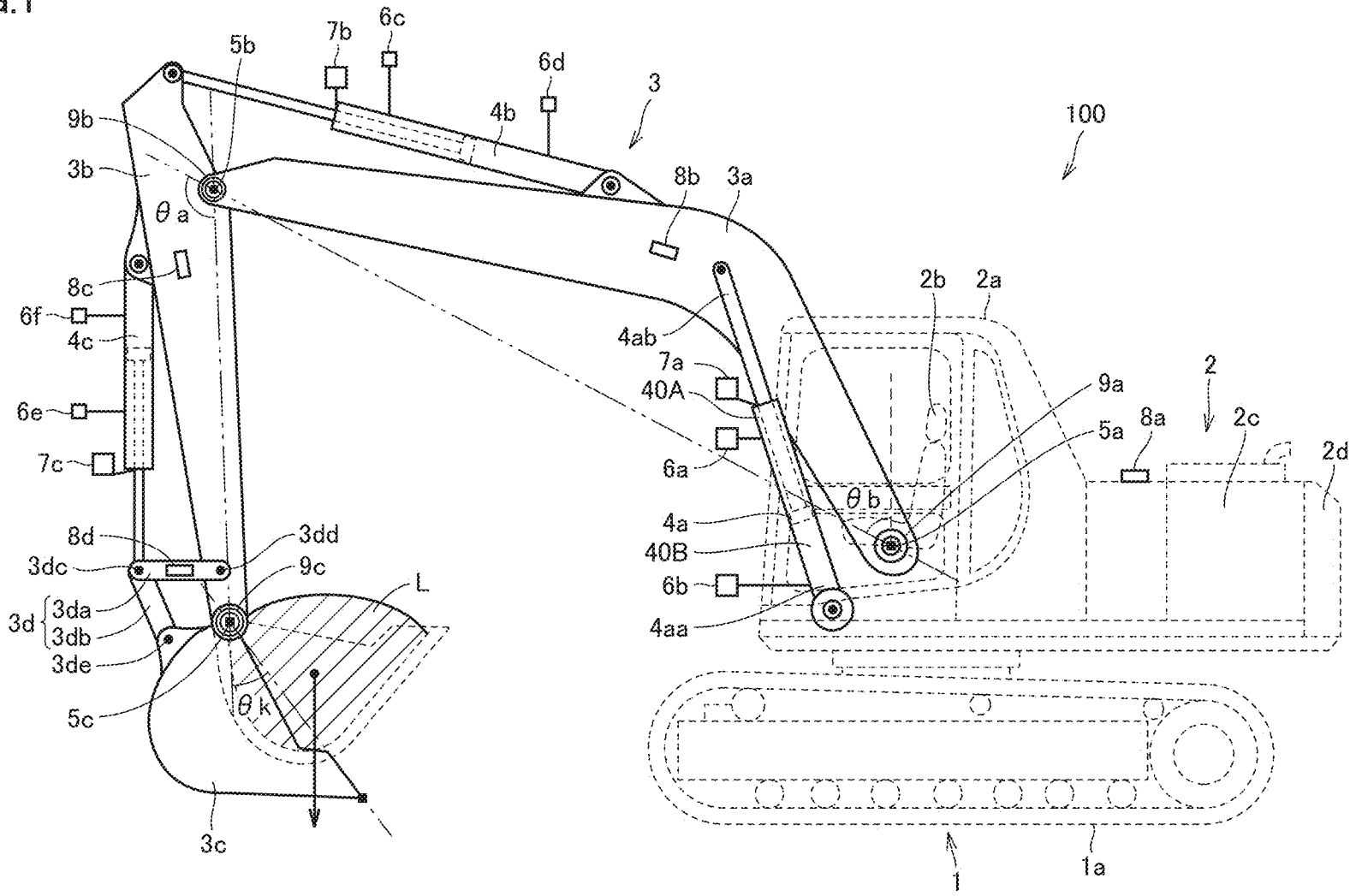
FIG. 1 is a diagram schematically showing a construction of a work machine based on a first embodiment of the present disclosure.

An embodiment will be described below with reference to the drawings. In the description below, the same components have the same reference characters allotted and their labels and functions are also identical. Therefore, detailed description thereof will not be repeated.

First Embodiment

<Construction of Work Machine>

FIG. 1 is a side view schematically showing a construction of a hydraulic excavator 100 as an exemplary work machine based on a first embodiment of the present disclosure. As shown in FIG. 1, hydraulic excavator 100 in the present embodiment mainly includes a traveling unit 1, a revolving unit 2, and a work implement 3. A vehicular body of hydraulic excavator 100 is constituted of traveling unit 1 and revolving unit 2.

Traveling unit 1 includes a pair of left and right crawler belt apparatuses 1*a*. Each of the pair of left and right crawler belt apparatuses 1*a* includes a crawler belt. As a pair of left and right crawler belts is rotationally driven, hydraulic excavator 100 travels.

Revolving unit 2 is provided as being revolvable with respect to traveling unit 1. Revolving unit 2 mainly includes an operator's cab (cab) 2*a*, an operator's seat 2*b*, an engine compartment 2*c*, and a counterweight 2*d*. Operator's cab 2*a* is arranged, for example, on the forward left (on a front side of a vehicle) of revolving unit 2. Operator's seat 2*b* where the operator takes a seat is arranged in an internal space in operator's cab 2*a*.

Each of engine compartment 2*c* and counterweight 2*d* is arranged on a rear side (on a rear side of the vehicle) of revolving unit 2 with respect to operator's cab 2*a*. An engine unit (an engine, an exhaust treatment structure, and the like) is accommodated in engine compartment 2*c*. An engine hood covers the top of engine compartment 2*c*. Counterweight 2*d* is arranged in the rear of engine compartment 2*c*.

Work implement 3 is pivotably supported on the front side of revolving unit 2, and for example, on the right of operator's cab 2*a*. Work implement 3 includes, for example, a boom 3*a*, an arm 3*b*, a bucket 3*c*, a boom cylinder 4*a*, an arm cylinder 4*b*, and a bucket cylinder 4*c*. Boom 3*a* has a base end (one end) rotatably coupled to revolving unit 2 by a boom bottom pin 5*a*. Arm 3*b* has a base end (one end) rotatably coupled to a tip end (the other end) of boom 3*a* by a boom top pin 5*b*. (One end of) bucket 3*c* is rotatably coupled to a tip end (the other end) of arm 3*b* by an arm top pin 5*c*.

In the present embodiment, positional relation of portions of hydraulic excavator 100 will be described with work implement 3 being defined as the reference.

Boom 3*a* of work implement 3 rotationally moves around boom bottom pin 5*a* with respect to revolving unit 2. A trace of movement of a specific portion of boom 3*a*, for example, the tip end of boom 3*a*, that pivots with respect to revolving unit 2 is in an arc shape, and a plane including the arc is identified. When hydraulic excavator 100 is two-dimensionally viewed from above, the plane is shown as a straight line. A direction of extension of this straight line is defined as a forward/rearward direction of the vehicular body of hydraulic excavator 100 or the forward/rearward direction of revolving unit 2, and it is also simply referred to as the forward/rearward direction below. A lateral direction (direction of a vehicle width) of the vehicular body of hydraulic excavator 100 or the lateral direction of revolving unit 2 is a direction orthogonal to the forward/rearward direction in a plan view and it is also simply referred to as the lateral direction below. An upward/downward direction of the vehicular body of hydraulic excavator 100 or the upward/downward direction of revolving unit 2 is a direction orthogonal to the plane defined by the forward/rearward direction and the lateral direction and it is also simply referred to as the upward/downward direction below.

In the forward/rearward direction, a side where work implement 3 protrudes from the vehicular body is defined as the forward direction and a direction opposite to the forward direction is the rearward direction. A right side and a left side in the lateral direction when one faces the forward direction are defined as a right direction and a left direction, respectively. A side where the ground is located and a side where the sky is located in the upward/downward direction are defined as a lower side and an upper side, respectively.

The forward/rearward direction refers to the forward/rearward direction of an operator who sits in operator's seat 2*b* in operator's cab 2*a*. The lateral direction refers to the lateral direction of the operator who sits in operator's seat 2*b*. The upward/downward direction refers to the upward/downward direction of the operator who sits in operator's seat 2*b*. A direction in which the operator sitting in operator's seat 2*b* faces is defined as the forward direction and a direction behind the operator sitting in operator's seat 2*b* is defined as the rearward direction. A right side and a left side at the time when the operator sitting in operator's seat 2*b* faces front are defined as the right direction and the left direction, respectively. A foot side of the operator who sits in operator's seat 2*b* is defined as the lower side and a head side is defined as the upper side.

Boom 3*a* can be driven by boom cylinder (boom hydraulic cylinder) 4*a*. As a result of this drive, boom 3*a* can pivot around boom bottom pin 5*a* in the upward/downward direction with respect to revolving unit 2. Arm 3*b* can be driven by arm cylinder (arm hydraulic cylinder) 4*b*. As a result of this drive, arm 3*b* can pivot around boom top pin 5*b* in the upward/downward direction with respect to boom 3*a*. Bucket (attachment) 3*c* can be driven by bucket cylinder (attachment hydraulic cylinder) 4*c*. As a result of this drive, bucket 3*c* can pivot around arm top pin 5*c* in the upward/downward direction with respect to arm 3*b*. Work implement 3 can thus be driven.

Boom bottom pin 5*a* is supported by the vehicular body of hydraulic excavator 100. Boom bottom pin 5*a* is supported by a pair of vertical plates (not shown) of a frame of revolving unit 2. Boom top pin 5*b* is attached to the tip end of boom 3*a*. Arm top pin 5*c* is attached to the tip end of arm 3*b*. Each of boom bottom pin 5*a*, boom top pin 5*b*, and arm top pin 5*c* extends in the lateral direction. Boom bottom pin 5*a* is also called a boom foot pin.

Work implement 3 includes a bucket link 3*d*. Bucket link 3*d* includes a first link member 3*da* and a second link member 3*db*. A tip end of first link member 3*da* and a tip end of second link member 3*db* are coupled to each other as being rotatable relative to each other with a bucket cylinder top pin 3*dc* being interposed. Bucket cylinder top pin 3*dc* is coupled to a tip end of bucket cylinder 4*c*. Therefore, first link member 3*da* and second link member 3*db* are coupled to bucket cylinder 4*c* with the pin being interposed.

First link member 3*da* has a base end rotatably coupled to arm 3*b* with a first link pin 3*dd* being interposed. Second link member 3*db* has a base end rotatably coupled to a bracket at a root of bucket 3*c* with a second link pin 3*de* being interposed.

A pressure sensor 6*a* is attached to a head side of boom cylinder 4*a*. Pressure sensor 6*a* can detect a pressure (a head pressure) of hydraulic oil within a cylinder-head-side oil chamber 40A of boom cylinder 4*a*. A pressure sensor 6*b* is attached to a bottom side of boom cylinder 4*a*. Pressure sensor 6*b* can detect a pressure (a bottom pressure) of hydraulic oil within a cylinder-bottom-side oil chamber 40B of boom cylinder 4*a*. Pressure sensors 6*a* and 6*b* output hydraulic oil pressure information defined by the head pressure and the bottom pressure to a controller 10 which will be described later.

A pressure sensor 6*c* is attached to a head side of arm cylinder 4*b*. Pressure sensor 6*c* can detect a pressure (a head pressure) of hydraulic oil within a cylinder-head-side oil chamber of arm cylinder 4*b*. A pressure sensor 6*d* is attached to a bottom side of arm cylinder 4*b*. Pressure sensor 6*d* can detect a pressure (a bottom pressure) of hydraulic oil within a cylinder-bottom-side oil chamber of arm cylinder 4*b*. Pressure sensors 6*c* and 6*d* output hydraulic oil pressure information defined by the head pressure and the bottom pressure to controller 10 which will be described later.

A pressure sensor 6*e* is attached to a head side of bucket cylinder 4*c*. Pressure sensor 6*e* can detect a pressure (a head pressure) of hydraulic oil within a cylinder-head-side oil chamber of bucket cylinder 4*c*. A pressure sensor 6*f* is attached to a bottom side of bucket cylinder 4*c*. Pressure sensor 6*f* can detect a pressure (a bottom pressure) of hydraulic oil within a cylinder-bottom-side oil chamber of bucket cylinder 4*c*. Pressure sensors 6*e* and 6*f* output hydraulic oil pressure information defined by the head pressure and the bottom pressure to controller 10 which will be described later.

Boom 3*a*, arm 3*b*, and bucket 3*c* are provided with respective position sensors for obtaining information on positions and attitudes thereof. The position sensors output boom information, arm information, and attachment information for obtaining the respective positions of boom 3*a*, arm 3*b*, and bucket 3*c* to controller 10 which will be described later.

A stroke sensor 7*a* is attached to boom cylinder 4*a* as a position sensor. Stroke sensor 7*a* detects an amount of displacement of a cylinder rod 4*ab* with respect to a cylinder 4*aa* in boom cylinder 4*a* as boom information. A stroke sensor 7*b* is attached to arm cylinder 4*b* as a position sensor. Stroke sensor 7*b* detects an amount of displacement of a cylinder rod in arm cylinder 4*b* as arm information. A stroke sensor 7*c* is attached to bucket cylinder 4*c* as a position sensor. Stroke sensor 7*c* detects an amount of displacement of a cylinder rod in bucket cylinder 4*c* as attachment information.

An angle sensor may be employed as the position sensor. An angle sensor 9*a* is attached around boom bottom pin 5*a*. An angle sensor 9*b* is attached around boom top pin 5*b*. An angle sensor 9*c* is attached around arm top pin 5*c*. Angle sensors 9*a*, 9*b*, and 9*c* may each be implemented by a potentiometer or a rotary encoder. Angle sensors 9*a*, 9*b*, and 9*c* output information on an angle of rotation of boom 3*a* and the like (boom information, arm information, and attachment information) to controller 10 which will be described later.

As shown in FIG. 1, in a side view, an angle formed between a straight line (shown with a chain double dotted line in FIG. 1) that passes through boom bottom pin 5*a* and boom top pin 5*b* and a straight line (shown with a dashed line in FIG. 1) that extends in the upward/downward direction is defined as a boom angle θb. Boom angle θb is normally an acute angle. Boom angle θb represents an angle of boom 3*a* with respect to revolving unit 2. Boom angle θb can be calculated from a result of detection by stroke sensor 7*a* or a measurement value from angle sensor 9*a*. In a side view, an angle formed between the straight line that passes through boom bottom pin 5*a* and boom top pin 5*b* and a straight line (shown with a chain double dotted line in FIG. 1) that passes through boom top pin 5*b* and arm top pin 5*c* is defined as an arm angle θa. Arm angle θa represents an angle of arm 3*b* with respect to boom 3*a* in an area where arm 3*b* pivots in the side view. Arm angle θa can be calculated from a result of detection by stroke sensor 7*b* or a measurement value from angle sensor 9*b*.

In a side view, an angle formed between the straight line that passes through boom top pin 5*b* and arm top pin 5*c* and a straight line (shown with a chain double dotted line in FIG. 1) that passes through arm top pin 5*c* and a cutting edge of bucket 3*c* is defined as a bucket angle θk. Bucket angle θk represents an angle of bucket 3*c* with respect to arm 3*b* in an area where bucket 3*c* pivots in the side view. Bucket angle θk can be calculated from a result of detection by stroke sensor 7*c* or a measurement value from angle sensor 9*c*.

An inertial measurement unit (IMU) may be employed as the position sensor. IMUs 8*a*, 8*b*, 8*c*, and 8*d* are attached to revolving unit 2, boom 3*a*, arm 3*b*, and first link member 3*da*, respectively. IMU 8*a* measures an acceleration of revolving unit 2 in the forward/rearward direction, the lateral direction, and the upward/downward direction and an angular velocity of revolving unit 2 around the forward/rearward direction, the lateral direction, and the upward/downward direction. IMUs 8*b*, 8*c*, and 8*d* measure accelerations of boom 3*a*, arm 3*b*, and first link member 3*da* in the forward/rearward direction, the lateral direction, and the upward/downward direction and angular velocities of boom 3*a*, arm 3*b*, and first link member 3*da* around the forward/rearward direction, the lateral direction, and the upward/downward direction, respectively.

Based on a difference between the acceleration measured by IMU 8*a* attached to revolving unit 2 and the acceleration measured by IMU 8*b* attached to boom 3*a*, an acceleration in extension and contraction of boom cylinder 4*a* (an amount of change in speed of extension and contraction of boom cylinder 4*a*) can be obtained. Boom angle θb, arm angle θa, and bucket angle θk may be calculated based on results of detection by IMUS 8*b*, 8*c*, and 8*d*, respectively.

Though a stroke sensor of each hydraulic cylinder, an angle sensor of each link such as boom 3*a*, and the IMU are given as exemplary position sensors, the position sensor may be a six-axis acceleration sensor. Some of the sensors may together be used as the position sensor. In addition to the sensors above, a global navigation satellite system (GNSS) may be used together as the position sensor.

<Schematic Configuration of System of Work Machine>

Figure 2:
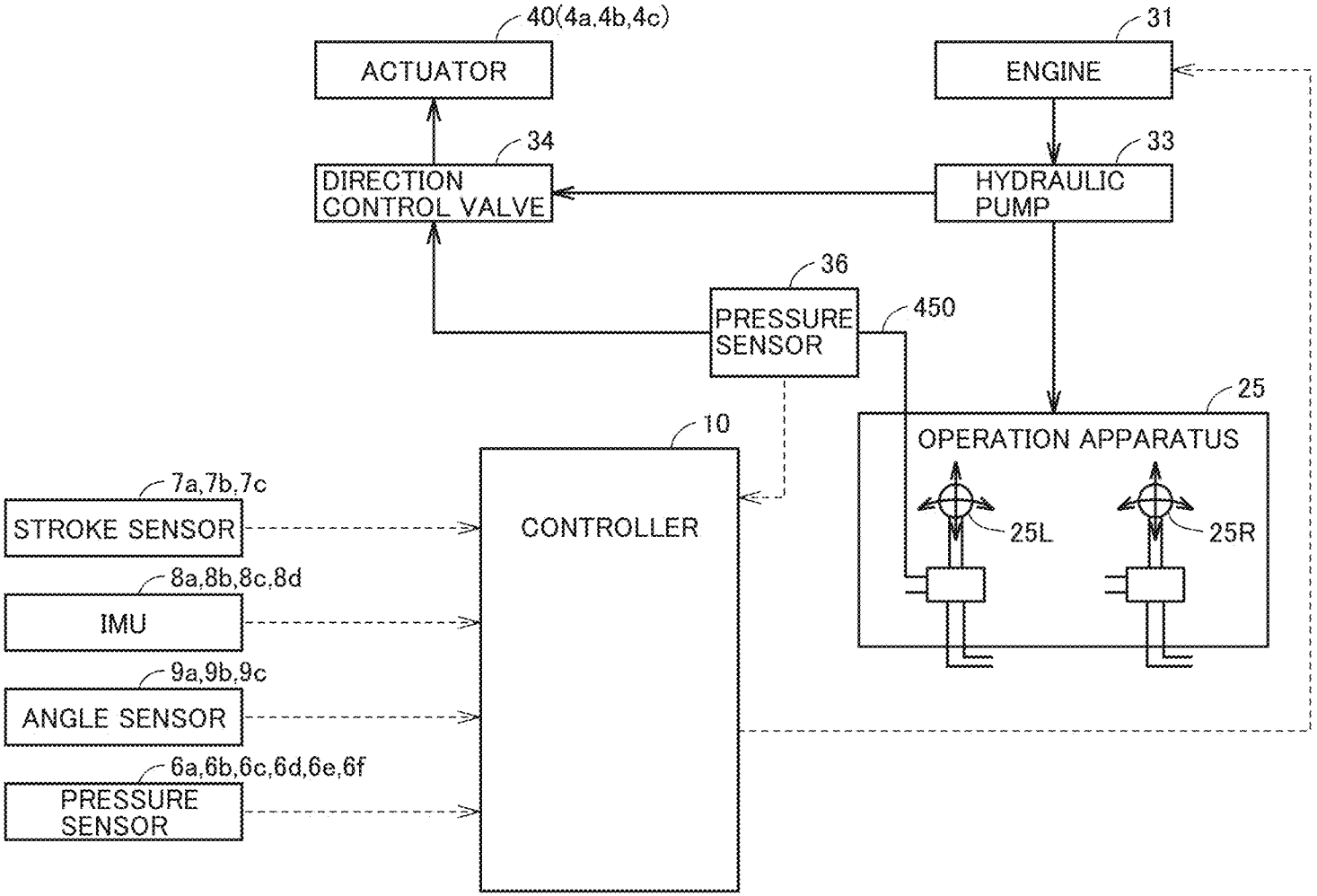
FIG. 2 is a block diagram showing a schematic configuration of a system of the work machine shown in FIG. 1.

A schematic configuration of a system of the work machine will now be described with reference to FIG. 2. FIG. 2 is a block diagram showing a schematic configuration of a system of the work machine shown in FIG. 1.

As shown in FIG. 2, the system in the present embodiment is a system for determining a load weight which is a weight of a load L (FIG. 1) conveyed by work implement 3. The system in the present embodiment includes hydraulic excavator 100 representing an exemplary work machine shown in FIG. 1 and controller 10 shown in FIG. 2. Controller 10 may be mounted on hydraulic excavator 100. Controller 10 may be provided outside hydraulic excavator 100. Controller 10 may be arranged at a worksite of hydraulic excavator 100 or at a remote location distant from the worksite of hydraulic excavator 100.

Engine 31 is, for example, a diesel engine. Output from engine 31 is controlled by control of an amount of injection of fuel into engine 31 by controller 10.

A hydraulic pump 33 is coupled to engine 31. As rotational drive force from engine 31 is transmitted to hydraulic pump 33, hydraulic pump 33 is driven. Hydraulic pump 33 is a variable displacement hydraulic pump that includes, for example, a swash plate and varies a delivery capacity as an angle of tilt of the swash plate is varied. Some of oil delivered from hydraulic pump 33 is supplied as hydraulic oil to a direction control valve 34. Some of oil delivered from hydraulic pump 33 is reduced in pressure by a pressure reduction valve and used as pilot oil.

Direction control valve 34 is a spool type valve that switches a direction of flow of hydraulic oil, for example, by moving a rod-shaped spool. As the spool moves in an axial direction, an amount of supply of hydraulic oil to an actuator 40 is regulated. Direction control valve 34 is provided with a spool stroke sensor that detects a distance of movement of the spool (spool stroke).

As supply and release of a hydraulic pressure to actuator 40 is controlled, an operation of work implement 3, revolution of revolving unit 2, and a traveling operation of traveling unit 1 are controlled. Actuator 40 includes boom cylinder 4*a*, arm cylinder 4*b*, and bucket cylinder 4*c* shown in FIG. 1 and a travel motor and a not-shown revolution motor.

In the present example, oil supplied to actuator 40 for activating actuator 40 is referred to as hydraulic oil. Oil supplied to direction control valve 34 for activating direction control valve 34 is referred to as pilot oil. A pressure of pilot oil is referred to as a pilot hydraulic pressure.

Hydraulic pump 33 may deliver both of hydraulic oil and pilot oil as above. Hydraulic pump 33 may separately include a hydraulic pump (a main hydraulic pump) that delivers hydraulic oil and a hydraulic pump (pilot hydraulic pump) that delivers pilot oil.

An operation apparatus 25 is arranged in operator's cab 2*a*. Operation apparatus 25 is operated by an operator. Operation apparatus 25 accepts an operation by the operator for driving work implement 3. Operation apparatus 25 accepts an operation by the operator for revolving revolving unit 2. Operation apparatus 25 provides an operation signal in response to an operation by the operator.

Operation apparatus 25 includes a first control lever 25R and a second control lever 25L. First control lever 25R is arranged, for example, on the right of operator's seat 2*b*. Second control lever 25L is arranged, for example, on the left of operator's seat 2*b*. Operations in front, rear, left, and right directions onto first control lever 25R and second control lever 25L correspond to biaxial operations.

For example, boom 3*a* and bucket 3*c* are operated by operating first control lever 25R. An operation onto first control lever 25R in the forward/rearward direction corresponds, for example, to an operation of boom 3*a*, and an operation to lower boom 3*a* and an operation to raise boom 3*a* are performed in accordance with the operation in the forward/rearward direction. An operation onto first control lever 25R in the lateral direction corresponds, for example, to an operation of bucket 3*c*, and an operation in a direction of excavation (upward) and a direction of dumping (downward) of bucket 3*c* is performed in accordance with the operation in the lateral direction.

For example, arm 3*b* and revolving unit 2 are operated by operating second control lever 25L. An operation in the forward/rearward direction onto second control lever 25L corresponds, for example, to revolution of revolving unit 2, and a right revolution operation and a left revolution operation of revolving unit 2 are performed in accordance with an operation in the forward/rearward direction. An operation onto second control lever 25L in the lateral direction corresponds, for example, to an operation of arm 3*b*, and the operation of arm 3*b* in the direction of dumping (upward) and the direction of excavation (downward) is performed in accordance with the operation in the lateral direction.

Pilot oil delivered from hydraulic pump 33 and reduced in pressure by the pressure reduction valve is supplied to operation apparatus 25. The pilot hydraulic pressure is regulated based on an amount of operation onto operation apparatus 25.

Operation apparatus 25 and direction control valve 34 are connected to each other through a pilot oil channel 450. Pilot oil is supplied to direction control valve 34 through pilot oil channel 450. A spool of direction control valve 34 is thus moved in the axial direction to regulate a direction of flow and a flow rate of hydraulic oil supplied to boom cylinder 4*a*, arm cylinder 4*b*, and bucket cylinder 4*c*, so that operations in the upward/downward direction of boom 3*a*, arm 3*b*, and bucket 3*c* are performed.

A pressure sensor 36 is arranged in pilot oil channel 450. Pressure sensor 36 detects the pilot hydraulic pressure. A result of detection by pressure sensor 36 is provided to controller 10. An amount of increase in pilot hydraulic pressure is different depending on an angle of tilt of each of control levers 25L and 25R from a neutral position. Contents of the operation onto operation apparatus 25 can be determined based on a result of detection of the pilot hydraulic pressure by pressure sensor 36.

Detection signals from stroke sensors 7*a* to 7*c*, IMUs 8*a* to 8*d*, angle sensors 9*a* to 9*c*, and pressure sensors 6*a* to 6*f* are also provided to controller 10.

Controller 10 may electrically be connected to each of stroke sensors 7*a* to 7*c*, IMUs 8*a* to 8*d*, angle sensors 9*a* to 9*c*, and pressure sensors 6*a* to 6*f* and 36 through wires, or may wirelessly communicate therewith. Controller 10 may be implemented, for example, by a computer, a server, or a portable terminal, or by a central processing unit (CPU).

Though operation apparatus 25 has been described above as being of a pilot hydraulic type, operation apparatus 25 may be an electrical operation apparatus. When operation apparatus 25 is electrical, an amount of operation onto each of first control lever 25R and second control lever 25L is detected, for example, by a potentiometer. The potentiometer is a displacement sensor that obtains an electrical (voltage) output in proportion to a mechanical position. A result of detection by the potentiometer is provided to controller 10. Contents of operation onto operation apparatus 25 can be determined based on a result of detection by the potentiometer.

<Functional Block in Controller 10>

Figure 3:
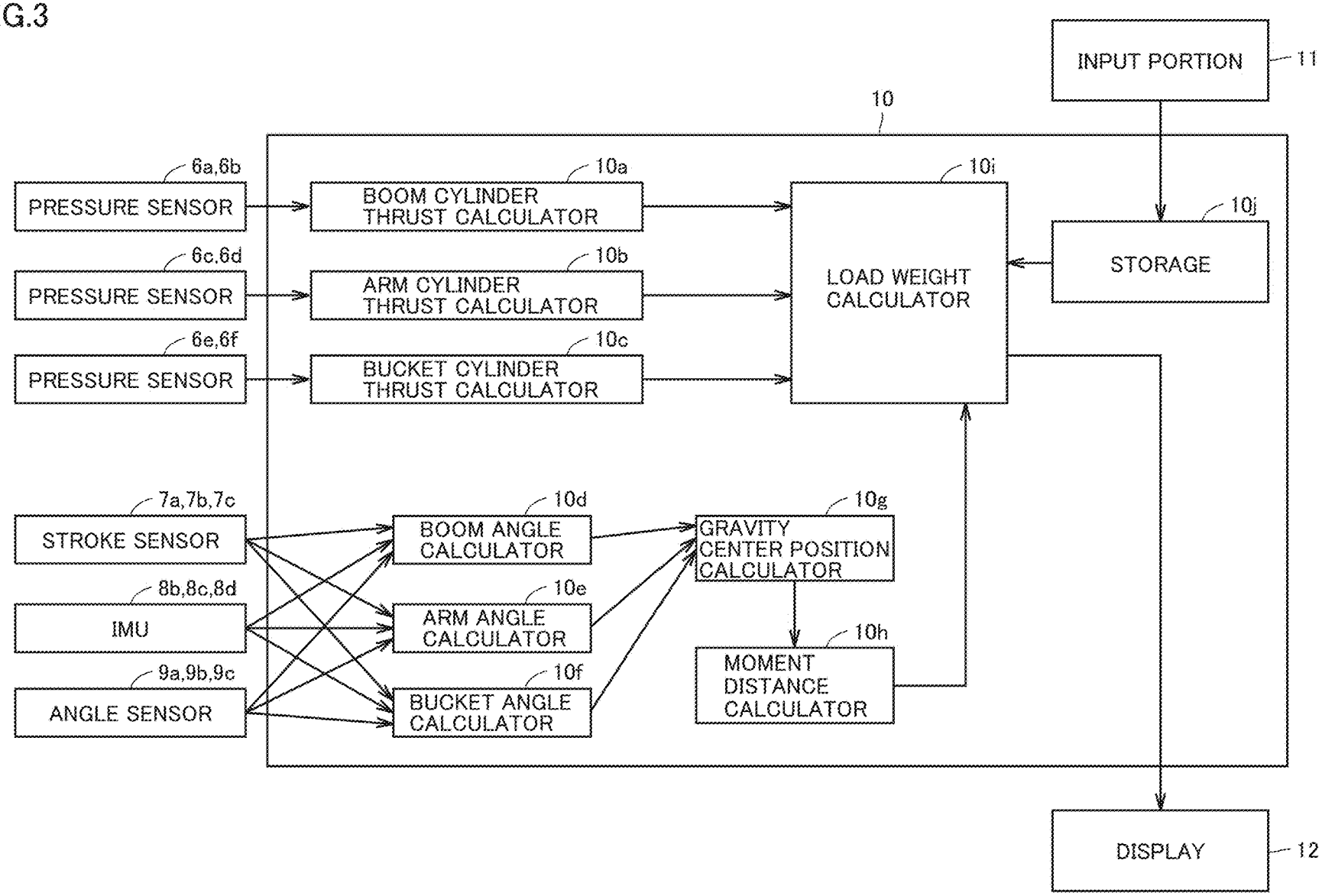
FIG. 3 is a diagram showing a functional block within a controller shown in FIG. 2.

A functional block in controller 10 will now be described with reference to FIG. 3. FIG. 3 is a diagram showing a functional block within controller 10 shown in FIG. 2.

As shown in FIG. 3, a boom cylinder thrust calculator 10*a* obtains a result of sensing by pressure sensors 6*a* and 6*b*. Specifically, boom cylinder thrust calculator 10*a* obtains the head pressure of boom cylinder 4*a* sensed by pressure sensor 6*a*. Boom cylinder thrust calculator 10*a* obtains the bottom pressure of boom cylinder 4*a* sensed by pressure sensor 6*b*. Boom cylinder thrust calculator 10*a* calculates boom cylinder thrust Fboom based on the head pressure and the bottom pressure of boom cylinder 4*a*.

Thrust is defined as force that moves an object in a direction of motion, and boom cylinder thrust Fboom is thrust generated by boom cylinder 4*a* that rotates boom 3*a* relatively to the vehicular body. Boom cylinder thrust Fboom is force applied in the direction of extension of boom cylinder 4*a*. Boom cylinder thrust calculator 10*a* outputs calculated boom cylinder thrust Fboom to a load weight calculator 10*i*.

An arm cylinder thrust calculator 10*b* obtains a result of sensing by pressure sensors 6*c* and 6*d*. Specifically, arm cylinder thrust calculator 10*b* obtains the head pressure of arm cylinder 4*b* sensed by pressure sensor 6*c*. Arm cylinder thrust calculator 10*b* obtains the bottom pressure of arm cylinder 4*b* sensed by pressure sensor 6*d*. Arm cylinder thrust calculator 10*b* calculates arm cylinder thrust Farm based on the head pressure and the bottom pressure of arm cylinder 4*b*.

Arm cylinder thrust Farm is thrust generated by arm cylinder 4*b* that rotates arm 3*b* relatively to boom 3*a*. Arm cylinder thrust Farm is force applied in the direction of extension of arm cylinder 4*b*. Arm cylinder thrust calculator 10*b* outputs calculated arm cylinder thrust Farm to load weight calculator 10*i*.

A bucket cylinder thrust calculator 10*c* obtains a result of sensing by pressure sensors 6*e* and 6*f*. Specifically, bucket cylinder thrust calculator 10*c* obtains the head pressure of bucket cylinder 4*c* sensed by pressure sensor 6*e*. Bucket cylinder thrust calculator 10*c* obtains the bottom pressure of bucket cylinder 4*c* sensed by pressure sensor 6*f*. Bucket cylinder thrust calculator 10*c* calculates bucket cylinder thrust Fbucket based on the head pressure and the bottom pressure of bucket cylinder 4*c*.

Bucket cylinder thrust Fbucket is thrust generated by bucket cylinder 4*c* that rotates bucket 3*c* relatively to arm 3*b*. Bucket cylinder thrust Fbucket is force applied in the direction of extension of bucket cylinder 4*c*. Bucket cylinder thrust calculator 10*c* outputs calculated bucket cylinder thrust Fbucket to load weight calculator 10*i*.

A boom angle calculator 10*d* obtains information on boom angle θb from at least one sensor of stroke sensor 7*a*, IMU 8*b*, and angle sensor 9*a*. Boom angle calculator 10*d* calculates boom angle θb based on the obtained information. Boom angle calculator 10*d* outputs calculated boom angle θb to a gravity center position calculator 10*g*.

An arm angle calculator 10*e* obtains information on arm angle θa from at least one sensor of stroke sensor 7*b*, IMU 8*c*, and angle sensor 9*b*. Arm angle calculator 10*e* calculates arm angle θa based on the obtained information. Arm angle calculator 10*e* outputs calculated arm angle θa to gravity center position calculator 10*g*.

A bucket angle calculator 10*f* obtains information on bucket angle θk from at least one sensor of stroke sensor 7*c*, IMU 8*d*, and angle sensor 9*c*. Bucket angle calculator 10*f* calculates bucket angle θk based on the obtained information. Bucket angle calculator 10*f* outputs calculated bucket angle θk to gravity center position calculator 10*g*.

Various types of information such as a dimension, a weight, and a position of the center of gravity of each member that makes up work implement 3 are stored in a storage 10*j*. Such various types of information may be inputted from an input portion 11 outside controller 10 into storage 10*j*. Storage 10*j* may be arranged outside controller 10, instead of being included in controller 10.

Gravity center position calculator 10*g* calculates a position relative to boom bottom pin 5*a*, of the center of gravity of each member that makes up work implement 3 such as boom 3*a*, cylinder 4*aa* of boom cylinder 4*a*, or first link member 3*da*. Gravity center position calculator 10*g* calculates the relative position of each member that makes up work implement 3 based on boom angle θb calculated by boom angle calculator 10*d*, arm angle θa calculated by arm angle calculator 10*e*, bucket angle θk calculated by bucket angle calculator 10*f*, and the position of the center of gravity of each member that makes up work implement 3, the position of the center of gravity being stored in storage 10*j*.

Gravity center position calculator 10*g* calculates attitudes of boom 3*a*, arm 3*b*, and bucket 3*c* with boom bottom pin 5*a* being defined as the reference, based on boom angle θb, arm angle θa, and bucket angle θk. Gravity center position calculator 10*g* calculates a state (attitude and stroke) of other constituent members of work implement 3 based on the calculated attitudes. Gravity center position calculator 10*g* calculates the relative position of each member that makes up work implement 3, with boom bottom pin 5*a* being defined as the reference, based on the result of calculation and the stored position of the center of gravity of each member.

A moment distance calculator 10*h* calculates a distance in a horizontal direction from boom bottom pin 5*a* to the center of gravity of each member that makes up the work implement. Specifically, moment distance calculator 10*h* calculates a distance Xboom in the horizontal direction from boom bottom pin 5*a* to the center of gravity of boom 3*a*.

Moment distance calculator 10*h* calculates a distance Xarm in the horizontal direction from boom bottom pin 5*a* to the center of gravity of arm 3*b*. Moment distance calculator 10*h* calculates a distance Xbucket in the horizontal direction from boom bottom pin 5*a* to the center of gravity of bucket 3*c*.

Moment distance calculator 10*h* calculates a distance XboomC in the horizontal direction from boom bottom pin 5*a* to the center of gravity of a cylinder portion (cylinder 4*aa*) of boom cylinder 4*a*. Moment distance calculator 10*h* calculates a distance XboomCR in the horizontal direction from boom bottom pin 5*a* to the center of gravity of a cylinder rod portion (cylinder rod 4*ab*) of boom cylinder 4*a*.

Moment distance calculator 10*h* calculates a distance XarmC in the horizontal direction from boom bottom pin 5*a* to the center of gravity of the cylinder portion of arm cylinder 4*b*. Moment distance calculator 10*h* calculates a distance XarmCR in the horizontal direction from boom bottom pin 5*a* to the center of gravity of the cylinder rod portion of arm cylinder 4*b*.

Moment distance calculator 10*h* calculates a distance Xboomtop in the horizontal direction from boom bottom pin 5*a* to boom top pin 5*b*. Moment distance calculator 10*h* calculates a distance Xarmtop in the horizontal direction from boom bottom pin 5*a* to arm top pin 5*c*.

Moment distance calculator 10*h* calculates a distance hboom from boom bottom pin 5*a* to boom cylinder 4*a* in a direction orthogonal to the direction of extension of boom cylinder 4*a*. Moment distance calculator 10*h* calculates a distance harm from boom top pin 5*b* to arm cylinder 4*b* in a direction orthogonal to the direction of extension of arm cylinder 4*b*. Moment distance calculator 10*h* calculates a distance hbucket from arm top pin 5*c* to bucket cylinder 4*c* in a direction orthogonal to the direction of extension of bucket cylinder 4*c*.

Moment distance calculator 10*h* outputs these calculated distances to load weight calculator 10*i*.

Load weight calculator 10*i* calculates a weight Mpayload of load L loaded in bucket 3*c*. A method of calculating weight Mpayload will be described later. Load weight calculator 10*i* outputs calculated weight Mpayload to a display 12 outside controller 10. Display 12 may be arranged, for example, in operator's cab 2*a* (FIG. 1) or at a remote location distant from hydraulic excavator 100. Display 12 shows calculated weight Mpayload on a screen. An operator who operates hydraulic excavator 100 in operator's cab 2*a*, an operator who operates hydraulic excavator 100 at a remote location, or a monitoring person who monitors an operation of hydraulic excavator 100 can recognize weight Mpayload of load L loaded in bucket 3*c* by looking at display 12.

Each of input portion 11 and display 12 may be connected to controller 10 through a wire or wirelessly.

<Calculation of Weight of Load L>

Details of the method of calculating weight Mpayload of load L loaded in bucket 3*c* will be described below. Weight Mpayload of load L is calculated based on any two of three relational expressions set up from information from the position sensors and information from the pressure sensors during conveyance of load L, in connection with three respective links (boom 3*a*, arm 3*b*, and bucket 3*c*) that make up work implement 3. With attention being paid below to boom 3*a* and bucket 3*c* as the links, moment equilibrium equations are set up as relational expressions to explain the method of calculating weight Mpayload of load L.

Figure 4:
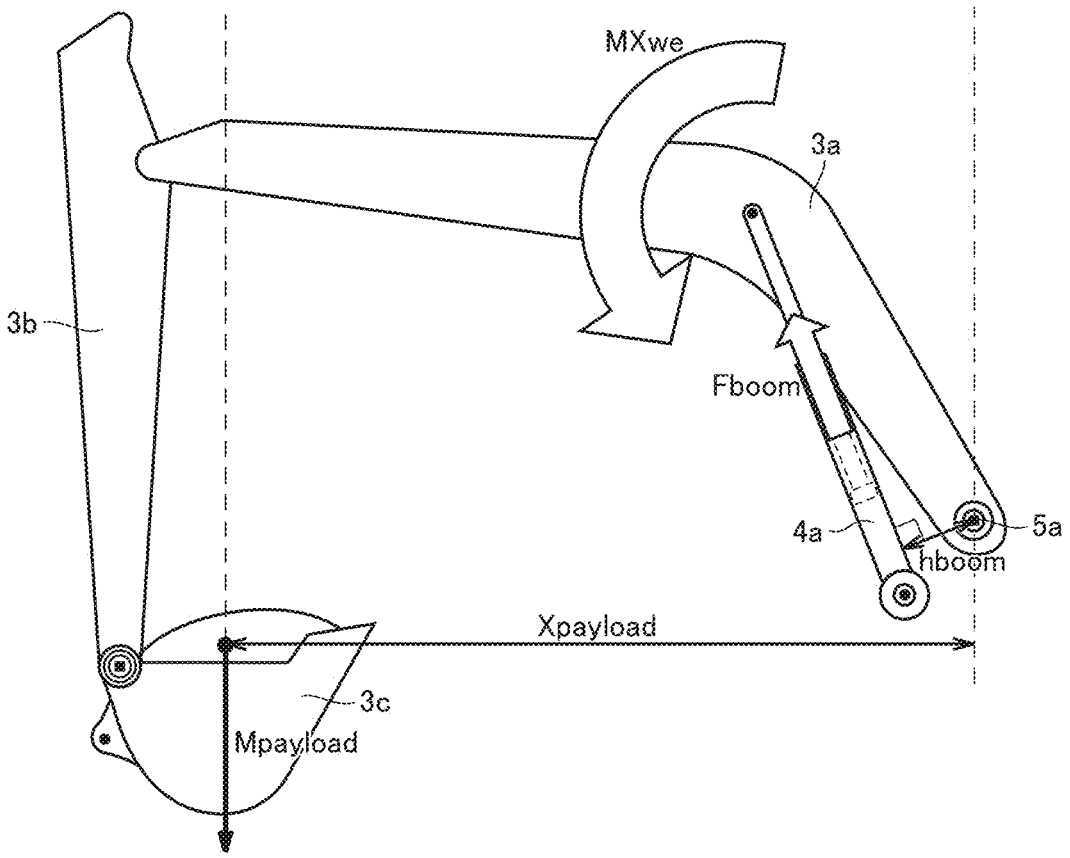
FIG. 4 is a schematic diagram showing moment equilibrium around a boom bottom pin.

Load weight calculator 10*i* shown in FIG. 3 reads an equation of moment equilibrium around boom bottom pin 5*a* from storage 10*j*. FIG. 4 is a schematic diagram showing moment equilibrium around boom bottom pin 5*a*. The equation of moment equilibrium around boom bottom pin 5*a* is expressed in an equation (1) below.

[Equation 1]

$$F_{boom} \times h_{boom} = M_{payload} \times X_{payload} + MX_{we} \tag{1}$$

The left side of the equation (1) expresses the moment resulting from boom cylinder thrust $F_{boom}$. In the first term in the right side of the equation (1), Mpayload represents the weight of load L loaded in bucket 3*c*. Xpayload represents a distance in the horizontal direction from boom bottom pin 5*a* to the position of the center of gravity of load L loaded in bucket 3*c*. The first term in the right side of the equation (1) expresses the moment resulting from load L loaded in bucket 3*c*.

MXwe in the second term in the right side of the equation (1) represents a moment resulting from a self-weight of work implement 3. Moment MXwe is calculated in an equation (2) below.

[Equation 2]

$$MX_{we} = M_{boom} \times X_{boom} + M_{boomC} \times X_{boomC} + M_{boomCR} \times X_{boomCR} + M_{arm} \times X_{arm} + M_{armC} \times X_{armC} + M_{armCR} \times X_{armC} + M_{bucket} \times X_{bucket} \tag{2}$$

In the equation (2), $M_{boom}$ represents a weight of boom 3*a*. $M_{boomC}$ represents a weight of the cylinder portion of boom cylinder 4*a*. $M_{boomCR}$ represents a weight of the cylinder rod portion of boom cylinder 4*a*. $M_{arm}$ represents a weight of arm 3*b*. $M_{armC}$ represents a weight of the cylinder portion of arm cylinder 4*b*. $M_{armCR}$ represents a weight of the cylinder rod portion of arm cylinder 4*b*. $M_{bucket}$ represents a weight of bucket 3*c*.

Each of these weights $M_{boom}$, $M_{boomC}$, $M_{boomCR}$, $M_{arm}$, $M_{armC}$, $M_{armCR}$, and $M_{bucket}$ is stored in storage 10*j*, for example, as a result of an operation for input into storage 10*j* with the use of input portion 11 shown in FIG. 3.

Figure 5:
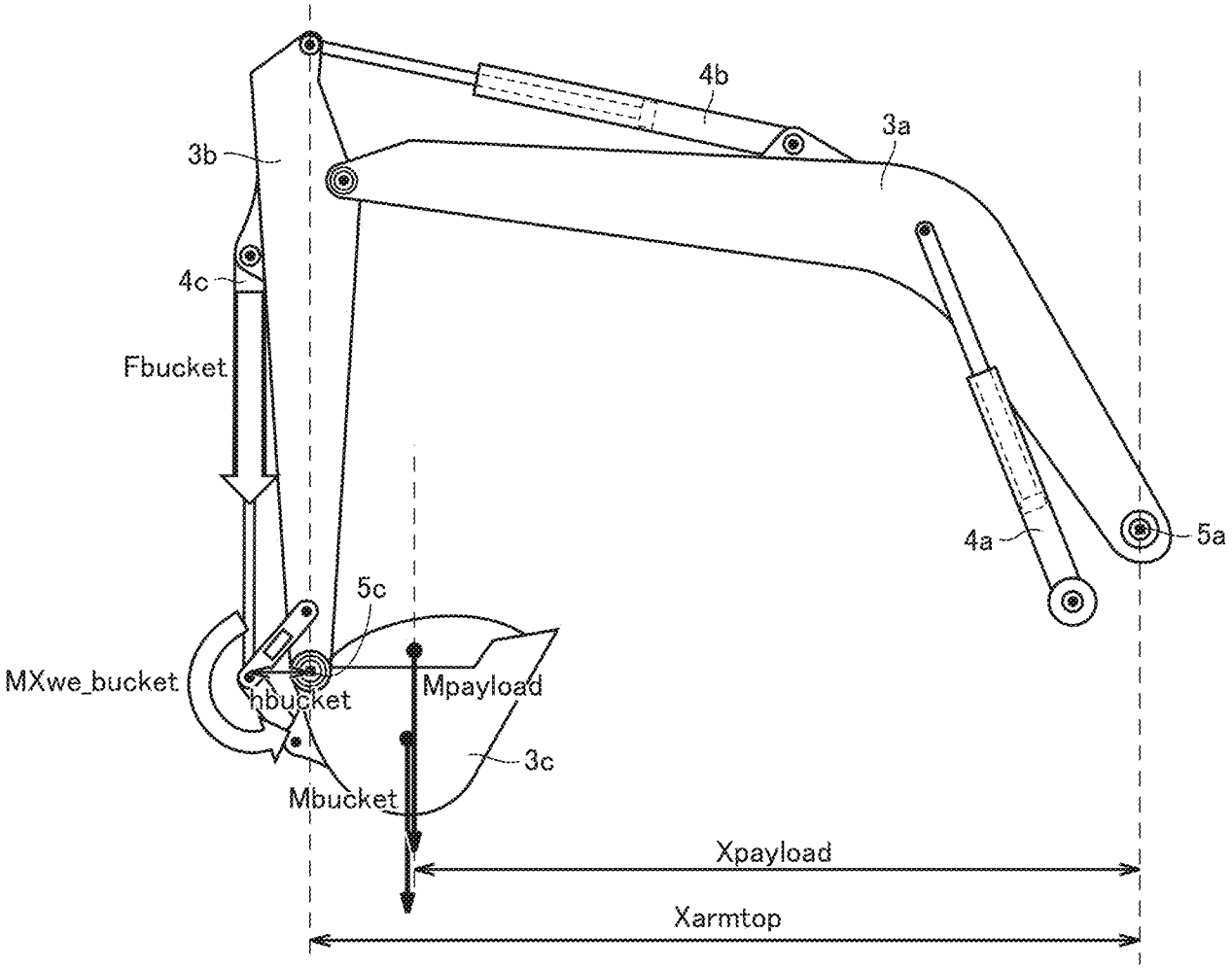
FIG. 5 is a schematic diagram showing moment equilibrium around an arm top pin.

Load weight calculator 10*i* then reads the equation of moment equilibrium around arm top pin 5*c* from storage 10*j*. FIG. 5 is a schematic diagram showing moment equilibrium around arm top pin 5*c*. The equation of moment equilibrium around arm top pin 5*c* is expressed in an equation (3) below.

[Equation 3]

$$F_{bucket} \times h_{bucket} = M_{payload} \times (X_{payload} - X_{armtop}) + MX_{we_bucket} \tag{3}$$

The left side of the equation (3) represents the moment resulting from thrust $F_{bucket}$ of bucket cylinder 4*c*. The first term in the right side of the equation (3) represents the moment resulting from load L loaded in bucket 3*c*. $MX_{we}$ bucket in the second term in the right side of the equation (3) represents a moment resulting from a self-weight of bucket 3*c*.

Based on the simultaneous equations of the equation (1) and the equation (3), an equation (4) below not dependent on distance Xpayload can be established as an equation for calculating load weight Mpayload.

[Equation 4]

$$M_{payload} = \frac{F_{boom} \times h_{boom} - F_{bucket} \times h_{bucket} - MX_{we} + MX_{we_bucket}}{X_{armtop}} \tag{4}$$

The equation (1) includes distance Xpayload and the equation (3) also includes distance Xpayload. By solving the two equilibrium equations as the simultaneous equations, the equation (4) not including distance Xpayload is derived. Load weight Mpayload can be calculated based on the equation (4). More accurate load weight Mpayload can thus be calculated without being affected by displacement of the position of the center of gravity of load L loaded in bucket 3*c*.

By substituting load weight Mpayload calculated in accordance with the equation (4) into the equation (1) or the equation (3), distance Xpayload can be calculated. An equation (5) below not dependent on load weight Mpayload can be established as an equation for calculating distance Xpayload from the simultaneous equations of the equation (1) and the equation (3).

[Equation 5]

$$X_{payload} = \frac{X_{armtop} \times (F_{boom} \times h_{boom} - MX_{we})}{F_{boom} \times h_{boom} - F_{bucket} \times h_{bucket} - MX_{we} + MX_{we_bucket}} \quad (5)$$

The position of the center of gravity of load L loaded in bucket 3*c* can be corrected in accordance with calculated distance Xpayload.

Figure 11:
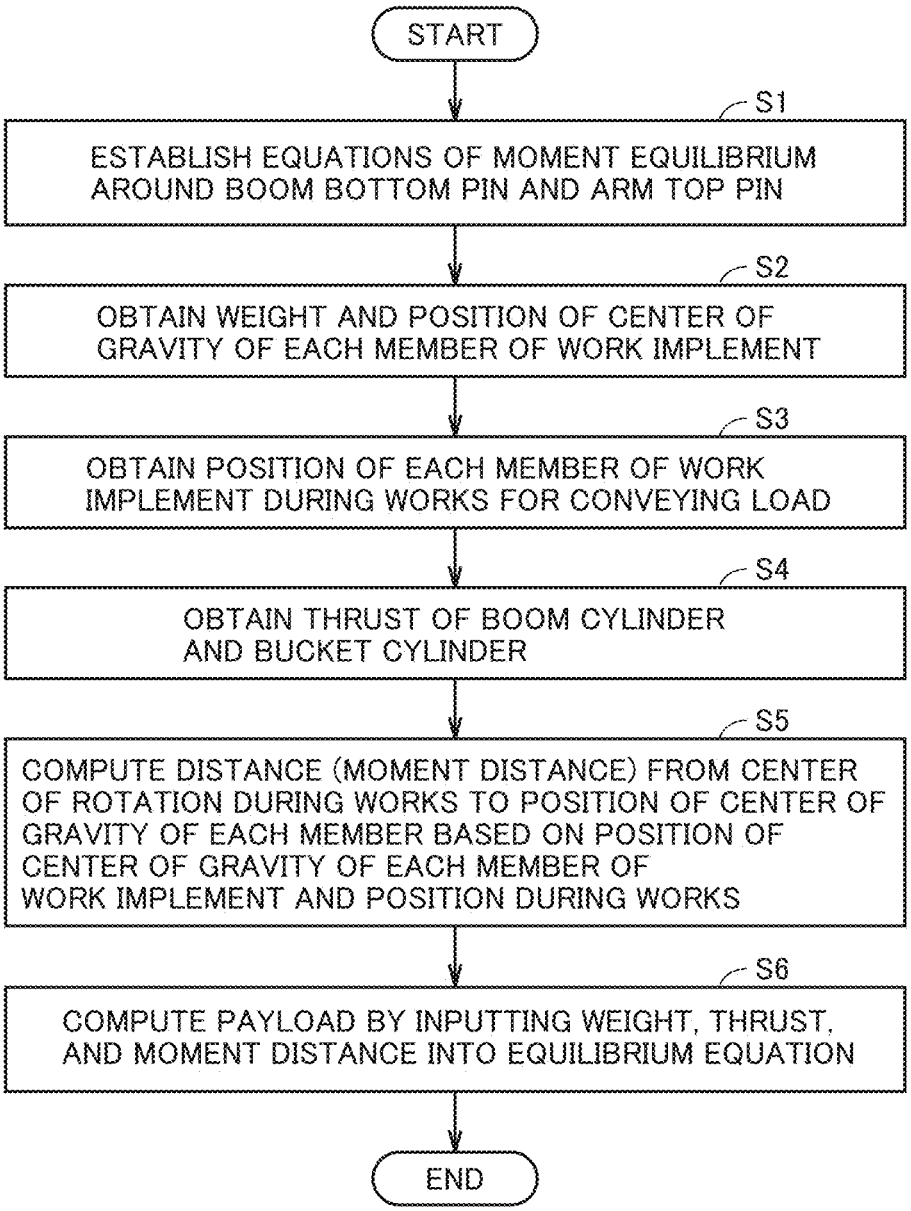
FIG. 11 is a diagram showing a flowchart of a computing method in the present disclosure.

In summary, a computing method of calculating weight Mpayload of load L conveyed in bucket 3*c* includes processing below. FIG. 11 is a diagram showing a flowchart of the computing method in the present disclosure.

Processing performed in step S1 shown in FIG. 11 is to establish, for the members of work implement 3, relational expressions of a motion around any two centers of rotation of boom bottom pin 5*a* (first center of rotation), boom top pin 5*b* (second center of rotation), and arm top pin 5*c* (third center of rotation). In the present embodiment, the relational expressions of the motion around the first center of rotation and the third center of rotation are established. The relational expression of the motion may be an equation of moment equilibrium around the center of rotation of the motion. The establishment of the equation may be to obtain information on the relational expression stored in storage 10*j*. The information on the relational expression obtained from storage 10*j* may be one relational expression organized about load weight Mpayload based on the relational expressions of the motion around the two centers of rotation.

Processing performed in step S2 is to obtain the weight and the position of the center of gravity of each of members that are boom 3*a*, arm 3*b*, and bucket 3*c* (attachment). Information on the center of gravity and the position of the center of gravity of each member may be obtained from storage 10*j*.

Processing performed in step S3 is to obtain a position of each member while load L is conveyed. The position of each member may be obtained by obtaining an angle of rotation of each member which represents the attitude of each member and computing the position based on the angle of rotation.

Processing performed in step S4 is to obtain thrust corresponding to the motion of the member in the relational expression of the motion of each member. In the present embodiment, thrust is obtained by measuring pressures of hydraulic oil in the hydraulic cylinders that operate boom 3*a* and bucket 3*c*. Thrust may be obtained from the head pressure and the bottom pressure of the hydraulic cylinder that pivots each of members that are boom 3*a*, arm 3*b*, and bucket 3*c* (attachment).

Processing performed in step S5 is to compute the distances in the horizontal direction (moment distance) between the positions of the centers of gravity of the members while load L is conveyed and respective ones of the first center of rotation, the second center of rotation, and the third center of rotation that are the centers of rotation of the members, based on the positions of the centers of gravity of the members and the positions of the members while load L is conveyed.

Processing performed in step S6 is to compute the weight (load weight Mpayload) of load L conveyed by work implement 3 by input of the obtained information and the computed information into the relational expressions of the motion of the members. The obtained information refers to the weight and the position of the center of gravity of each member of work implement 3 and thrust of the hydraulic cylinder that pivots each member while load L is conveyed. The computed information refers to the distance in the horizontal direction between the position of the center of gravity of each member while load L is conveyed and the center of rotation of each member.

Second Embodiment

In the first embodiment, an example in which weight Mpayload of load L loaded in bucket 3*c* is calculated based on the two equilibrium equations of the equation of moment equilibrium around boom bottom pin 5*a* and the equation of moment equilibrium around arm top pin 5*c* is described. Without being limited to this example, controller 10 can calculate weight Mpayload of load L loaded in bucket 3*c* based on any two equilibrium equations of the equation of moment equilibrium around boom bottom pin 5*a*, the equation of moment equilibrium around boom top pin 5*b*, and the equation of moment equilibrium around arm top pin 5*c*. In a second embodiment, an example in which weight Mpayload is calculated based on the two equilibrium equations of the equation of moment equilibrium around boom bottom pin 5*a* and the equation of moment equilibrium around boom top pin 5*b* will be described.

The construction of hydraulic excavator 100, the system configuration, and the functional block in controller 10 in the second embodiment are as described in the first embodiment with reference to FIGS. 1 to 3.

Figure 6:
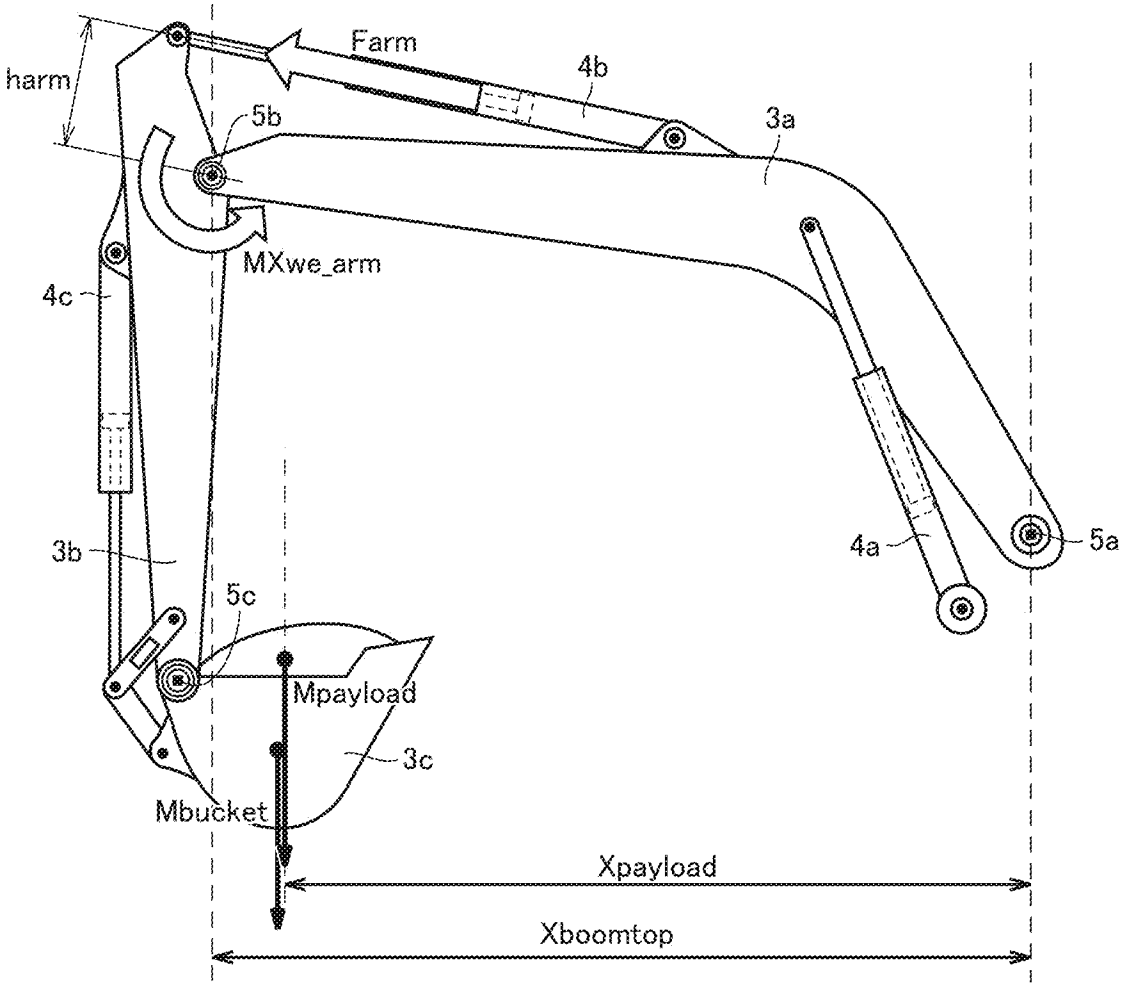
FIG. 6 is a schematic diagram showing moment equilibrium around a boom top pin.

In the second embodiment, load weight calculator 10*i* reads the equation of moment equilibrium around boom top pin 5*b* from storage 10*j*. FIG. 6 is a schematic diagram showing equilibrium of the moment around boom top pin 5*b*. The equation of moment equilibrium around boom top pin 5*b* is expressed in an equation (6) below.

[Equation 6]

$$F_{arm} \times h_{arm} = M_{payload} \times (X_{payload} - X_{boomtop}) + MX_{we_arm} \quad (6)$$

The left side of the equation (6) expresses the moment resulting from arm cylinder thrust $F_{arm}$. The first term in the right side of the equation (6) expresses the moment resulting from load L loaded in bucket 3*c*. $MX_{we}$_arm in the second term in the right side of the equation (6) represents the moment resulting from the self-weight of work implement 3 on a tip end side of work implement 3 relative to boom top pin 5*b*. Moment $MX_{we}$_arm is calculated based on the equilibrium equation similar to the equation (2).

From the simultaneous equations of the equation (1) and the equation (6), an equation (7) below not dependent on distance Xpayload can be established as an equation for calculating load weight Mpayload.

[Equation 7]

$$M_{payload} = \frac{F_{boom} \times h_{boom} - F_{arm} \times h_{arm} - MX_{we} + MX_{we_arm}}{X_{boomtop}} \quad (7)$$

The equation (1) includes distance Xpayload and the equation (6) also includes distance Xpayload. By solving the two equilibrium equations as the simultaneous equations, the equation (7) not including distance Xpayload is derived. Load weight Mpayload can be calculated based on the equation (7). More accurate load weight Mpayload can thus be calculated without being affected by displacement of the position of the center of gravity of load L loaded in bucket 3*c*.

By substituting load weight Mpayload calculated in accordance with the equation (7) into the equation (1) or the equation (6), distance Xpayload can be calculated. An equation not dependent on load weight Mpayload can be established as an equation for calculating distance Xpayload from the simultaneous equations of the equation (1) and the equation (6). The position of the center of gravity of load L loaded in bucket 3*c* can be corrected in accordance with calculated distance Xpayload.

In the description of the first and second embodiments, an example in which load weight Mpayload which is the weight of load L loaded in bucket 3*c* is calculated is described. Without being limited thereto, for example, the weight of a suspended load can accurately be calculated by applying the concept in the embodiments, for example, to hydraulic excavator 100 of arm crane specifications in which a hook is attached to second link pin 3*de* to lift up and down load L.

In hydraulic excavator 100 shown in the first and second embodiments, three links (boom 3*a*, arm 3*b*, and bucket 3*c*) of work implement 3 include position sensors 9*a*, 9*b*, and 9*c* and corresponding pressure sensors 6*a*, 6*b*, and 6*c*, respectively, however, the construction is not limited as such. The pressure sensor may be provided only in links associated with two relational expressions used for calculation of load weight Mpayload.

Third Embodiment

In the first and second embodiments, hydraulic excavator 100 including bucket 3*c* as the attachment at the tip end of work implement 3 is described. The attachment is not limited to bucket 3*c*, and the attachment may be changed to a grapple, a lifting magnet, or the like depending on a type of works. In a third embodiment, hydraulic excavator 100 including a lifting magnet 103 as the attachment will be described.

Figure 7:
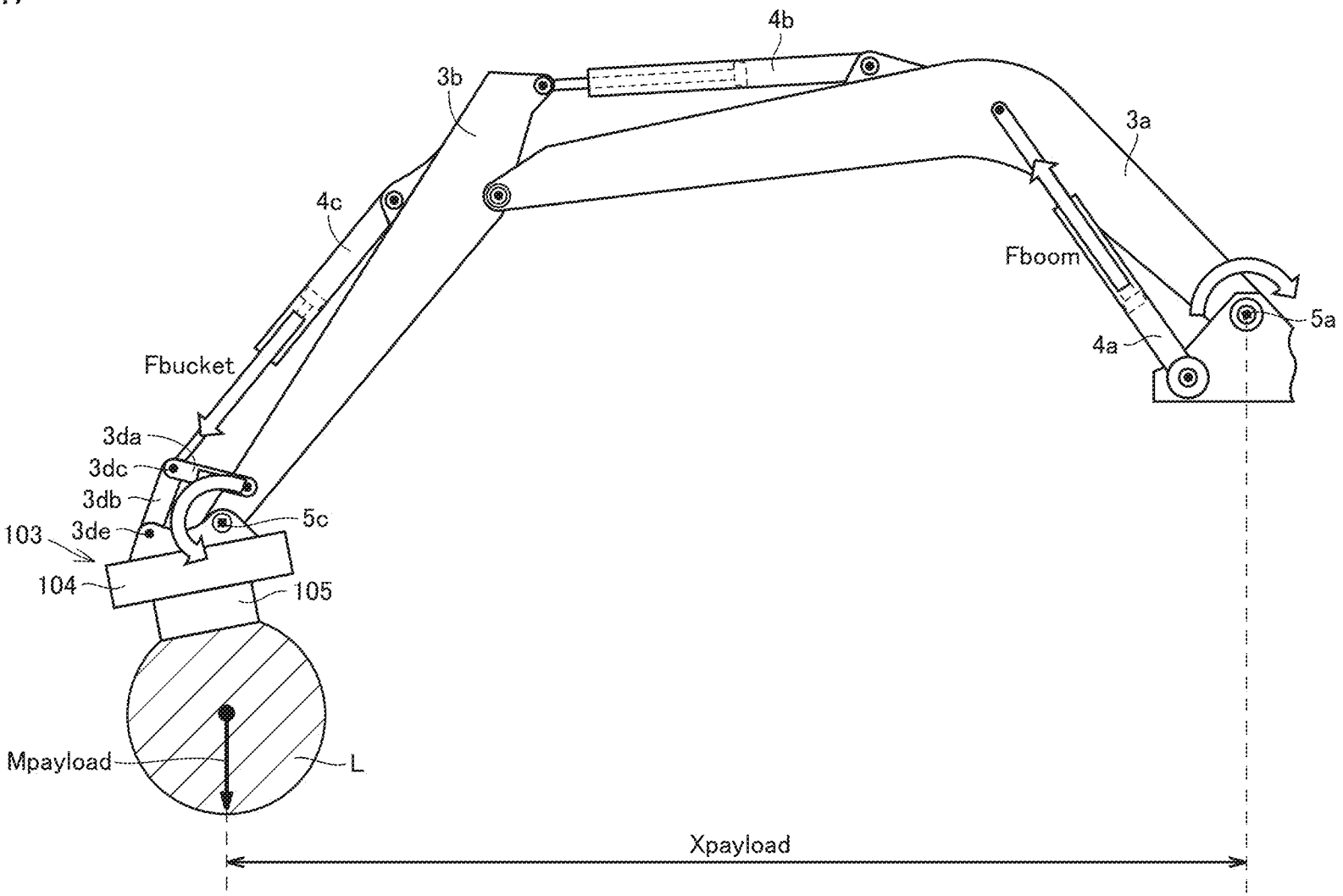
FIG. 7 is a diagram schematically showing a construction of a work machine based on a third embodiment.

FIG. 7 is a side view schematically showing a construction of hydraulic excavator 100 as an exemplary work machine based on the third embodiment. Hydraulic excavator 100 based on the third embodiment is substantially identical in construction to hydraulic excavator 100 in the first embodiment shown in FIG. 1, and different in including lifting magnet 103 instead of bucket 3*c* at the tip end of work implement 3.

Lifting magnet 103 includes a main body portion 105 and a support portion 104. Main body portion 105 is made of a magnet that generates magnetic force. Main body portion 105 is made, for example, of an electromagnet. Main body portion 105 can hold and convey a magnetic material by magnetic force. Support portion 104 supports main body portion 105. Support portion 104 is rotatably coupled to the tip end of arm 3*b* by arm top pin 5*c*. Second link member 3*db* has the base end rotatably coupled to a bracket at a root portion of support portion 104 by second link pin 3*de*.

In hydraulic excavator 100 including lifting magnet 103, it is difficult to keep a constant position of load L conveyed by work implement 3, that is, the magnetic material attracted and held by main body portion 105, relative to main body portion 105 and a constant attitude of the magnetic material. Therefore, the position of the center of gravity of the magnetic material tends to be displaced. As shown in FIG. 7, a more accurate weight of load L can be calculated without being affected by displacement of the position of the center of gravity of load L held by lifting magnet 103 by establishing an equation for calculating the weight of load L not dependent on displacement of the position of the center of gravity of load L, based on two equilibrium equations of the equation of moment equilibrium around boom bottom pin 5*a* and the equation of moment equilibrium around arm top pin 5*c*.

In hydraulic excavator 100 shown in the first to third embodiments, the weight of load L can more accurately be calculated by calculating the weight of load L during revolution of revolving unit 2 with respect to traveling unit 1.

Fourth Embodiment

In the first to third embodiments, an example in which hydraulic excavator 100 is defined as the work machine is described. Without being limited to hydraulic excavator 100, the weight of load L conveyed by work implement 3 can accurately be calculated by applying the concept of the embodiments to a work machine including work implement 3 with a multiple-link mechanism that conveys load L. For example, the work machine may be a wheel loader, a back hoe loader, or a skid steer loader.

Figure 8:
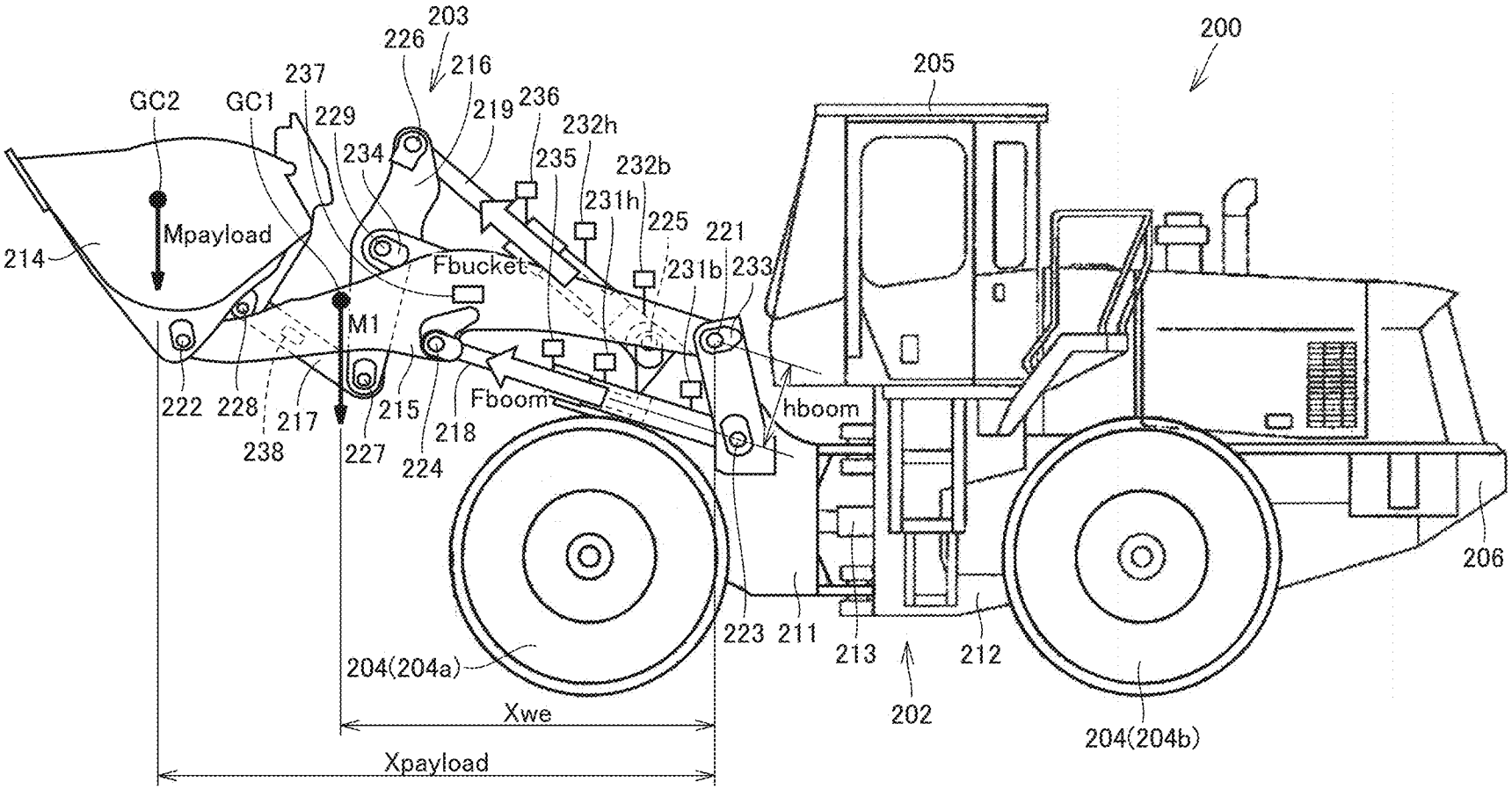
FIG. 8 is a diagram schematically showing a construction of a work machine based on a fourth embodiment.

FIG. 8 is a side view schematically showing a construction of a wheel loader 200 as an exemplary work machine based on a fourth embodiment. As shown in FIG. 8, wheel loader 200 includes a vehicular body frame 202, a work implement 203, a traveling apparatus 204, and a cab 205.

A vehicular body of wheel loader 200 is composed of vehicular body frame 202 and cab 205. In cab 205, a seat where an operator sits and an operation apparatus are arranged. Work implement 203 and traveling apparatus 204 are attached to the vehicular body of wheel loader 200. Work implement 203 is arranged in front of the vehicular body and a counterweight 206 is provided at a rearmost end of the vehicular body.

Vehicular body frame 202 includes a front frame 211 and a rear frame 212. A steering cylinder 213 is attached to front frame 211 and rear frame 212. Steering cylinder 213 is a hydraulic cylinder. Steering cylinder 213 extends and contracts by hydraulic oil from a steering pump (not shown). As steering cylinder 213 extends and contracts, front frame 211 and rear frame 212 can swing with respect to each other in the lateral direction. A direction of travel of wheel loader 200 can thus laterally be changed.

In the fourth embodiment, a direction in which wheel loader 200 travels straight is herein referred to as a forward/rearward direction of wheel loader 200. In the forward/rearward direction of wheel loader 200, a side on which work implement 203 is arranged with respect to vehicular body frame 202 is defined as a forward direction, and a side opposite to the forward direction is defined as a rearward direction. A lateral direction of wheel loader 200 is a direction orthogonal to the forward/rearward direction in a plan view. When looking in the forward direction, a right side and a left side in the lateral direction are a right direction and a left direction, respectively. An upward/downward direction of wheel loader 200 is a direction orthogonal to a plane defined by the forward/rearward direction and the lateral direction. In the upward/downward direction, a side on which the ground is present is a lower side and a side on which the sky is present is an upper side.

Traveling apparatus 204 includes running wheels 204*a* and 204*b*. Each of running wheels 204*a* and 204*b* is a wheel and includes a tire made of rubber. Running wheel (front wheel) 204*a* is rotatably attached to front frame 211. Running wheel (rear wheel) 204*b* is rotatably attached to rear frame 212. Wheel loader 200 can be self-propelled as running wheels 204*a* and 204*b* are rotationally driven.

Work implement 203 serves to do such works as excavation. Work implement 203 is attached to front frame 211. Work implement 203 includes a bucket 214, a boom 215, a bell crank 216, a tilt rod 217, a boom cylinder 218, and a bucket cylinder 219.

Boom 215 has a base end rotatably attached to front frame 211 by a boom bottom pin 221. Boom 215 is thus rotatably attached to the vehicular body. Bucket 214 is rotatably attached to a tip end of boom 215 by a boom top pin 222. Boom bottom pin 221 is supported by the vehicular body of wheel loader 200. Boom top pin 222 is attached to the tip end of boom 215. Boom bottom pin 221 and boom top pin 222 extend in the lateral direction.

Boom cylinder 218 drives boom 215. Boom cylinder 218 has one end rotatably attached to front frame 211 of the vehicular body by a pin 223. Boom cylinder 218 is thus rotatably attached to the vehicular body. Boom cylinder 218 has the other end rotatably attached to boom 215 by a pin 224.

Boom cylinder 218 is, for example, a hydraulic cylinder. Boom cylinder 218 extends and contracts by hydraulic oil from a work implement pump (not shown). Boom 215 is thus driven and bucket 214 attached to the tip end of boom 215 is moved upward and downward.

Bell crank 216 is rotatably supported on boom 215 by a support pin 229. Bell crank 216 has a first end located on one side of support pin 229 and a second end located opposite to the first end with respect to support pin 229. Bell crank 216 has the first end connected to bucket 214 with tilt rod 217 being interposed. Bell crank 216 has the second end connected to front frame 211 of the vehicular body with bucket cylinder 219 being interposed.

Tilt rod 217 has one end rotatably attached to the first end of bell crank 216 by a pin 227. Tilt rod 217 has the other end rotatably attached to bucket 214 by a pin 228.

Bucket cylinder 219 drives bucket 214 with respect to boom 215. Bucket cylinder 219 has one end rotatably attached to front frame 211 of the vehicular body by a pin 225. Bucket cylinder 219 has the other end rotatably attached to the second end of bell crank 216 by a pin 226.

Bucket cylinder 219 is, for example, a hydraulic cylinder. Bucket cylinder 219 extends and contracts by hydraulic oil from a work implement pump (not shown). As bucket cylinder 219 extends and contracts, bell crank 216 is driven to rotate with respect to boom 215. As rotation of bell crank 216 is transmitted to bucket 214 through tilt rod 217, bucket 214 is driven and pivots upward and downward with respect to boom 215. Bell crank 216 corresponds to the pivot member in the embodiment that can rotate with respect to boom 215 together with bucket 214.

Wheel loader 200 further includes a sensor that senses information on thrust $F_{boom}$ of boom cylinder 218 and a sensor that senses information on thrust $F_{bucket}$ of bucket cylinder 219.

The sensor that senses information on thrust $F_{boom}$ of boom cylinder 218 is, for example, pressure sensors 231*b* and 231*h*. Each of pressure sensors 231*b* and 231*h* senses a cylinder pressure of boom cylinder 218. Pressure sensor 231*b* senses a bottom pressure of boom cylinder 218. Pressure sensor 231*h* senses a head pressure of boom cylinder 218.

The head pressure means a pressure on a cylinder rod side with respect to a piston of a hydraulic cylinder and the bottom pressure means a pressure on a tube side with respect to the piston.

The sensor that senses information on thrust $F_{bucket}$ of bucket cylinder 219 is, for example, pressure sensors 232*b* and 232*h*. Each of pressure sensors 232*b* and 232*h* senses a cylinder pressure of bucket cylinder 219. Pressure sensor 232*b* senses a bottom pressure of bucket cylinder 219. Pressure sensor 232*h* senses a head pressure of bucket cylinder 219.

Wheel loader 200 further includes a sensor that senses information on an attitude of work implement 203. The sensor that senses information on the attitude of work implement 203 includes, for example, a first sensor that senses information on a boom angle and a second sensor that senses information on a bucket angle with respect to the boom.

Figure 10:
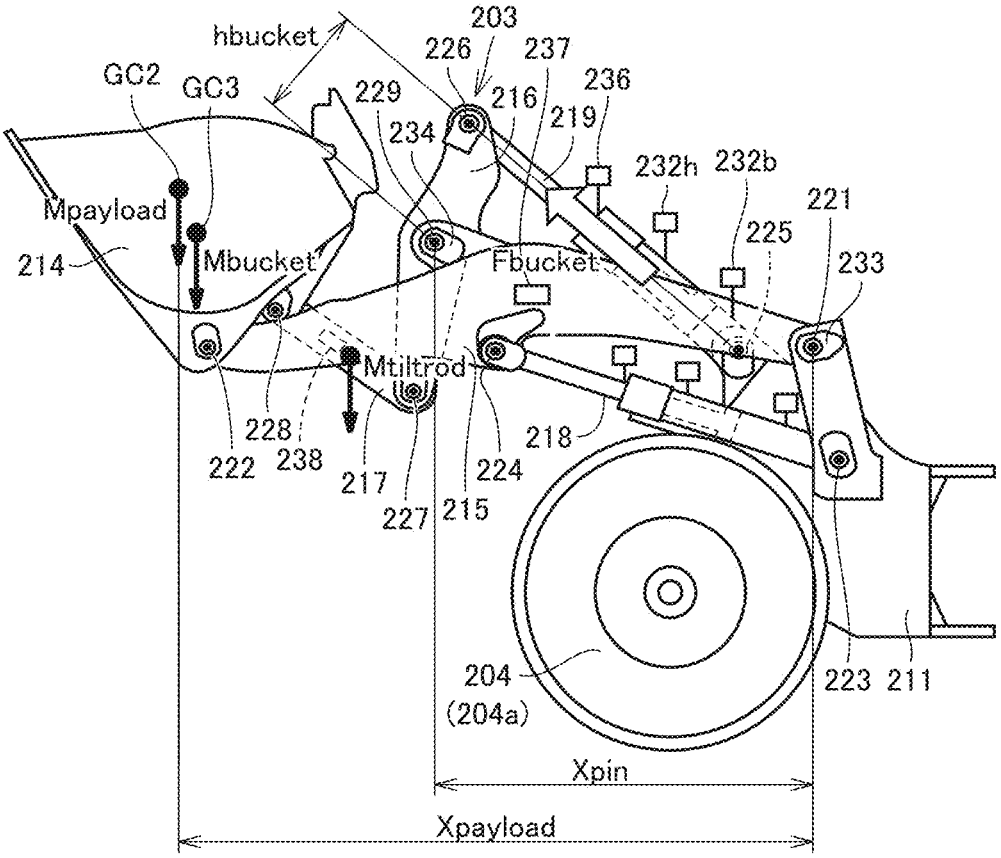
FIG. 10 is a schematic diagram showing moment equilibrium around a support pin.

The information on the attitude of work implement 203 includes distance $h_{boom}$ and distance $h_{bucket}$ (FIG. 10). Distance $h_{boom}$ is a distance between boom bottom pin 221 and pin 223 in a direction orthogonal to a direction of extension of boom cylinder 218. Distance $h_{bucket}$ is a distance between support pin 229 and pin 226 in a direction orthogonal to a direction of extension of bucket cylinder 219.

The boom angle refers to an angle of boom 215 with respect to front frame 211 of the vehicular body. The bucket angle refers to an angle of bucket 214 with respect to boom 215.

The first sensor that senses information on the boom angle is, for example, a potentiometer 233. Potentiometer 233 is attached as being concentric with boom bottom pin 221. Instead of potentiometer 233, a stroke sensor 235 of boom cylinder 218 may be employed as the first sensor that senses information on the boom angle.

An inertial measurement unit (IMU) 237 may be employed as the first sensor that senses information on the boom angle. IMU 237 is attached, for example, to boom 215.

The second sensor that senses information on the bucket angle is, for example, a potentiometer 234. Potentiometer 234 is attached as being concentric with support pin 229. Instead of potentiometer 234, a stroke sensor 236 of bucket cylinder 219 may be employed as the second sensor that senses information on the bucket angle.

An IMU 238 may be employed as the second sensor that senses information on the bucket angle. IMU 238 is attached, for example, to tilt rod 217.

Potentiometers 233 and 234, stroke sensors 235 and 236, and IMUs 237 and 238 may be used as a sensor that senses information on a position of a center of gravity GC1 of work implement 203. Information on the position of center of gravity GC1 of work implement 203 is a distance Xwe.

Distance Xwe represents a distance between center of gravity GC1 and boom bottom pin 221 along the forward/rearward direction of wheel loader 200. Distance Xwe represents a distance along the horizontal direction between center of gravity GC1 and boom bottom pin 221 while wheel loader 200 is placed on a horizontal ground.

Potentiometers 233 and 234, stroke sensors 235 and 236, and IMUs 237 and 238 may be used as the sensor that senses information on a position of a center of gravity GC2 of a load within bucket 214. Information on the position of center of gravity GC2 of the load within bucket 214 is distance Xpayload.

Distance Xpayload represents a distance between center of gravity GC2 and boom bottom pin 221 along the forward/rearward direction of wheel loader 200. Xpayload represents a distance along the horizontal direction between center of gravity GC2 and boom bottom pin 221 while wheel loader 200 is placed on the horizontal ground.

Figure 9:
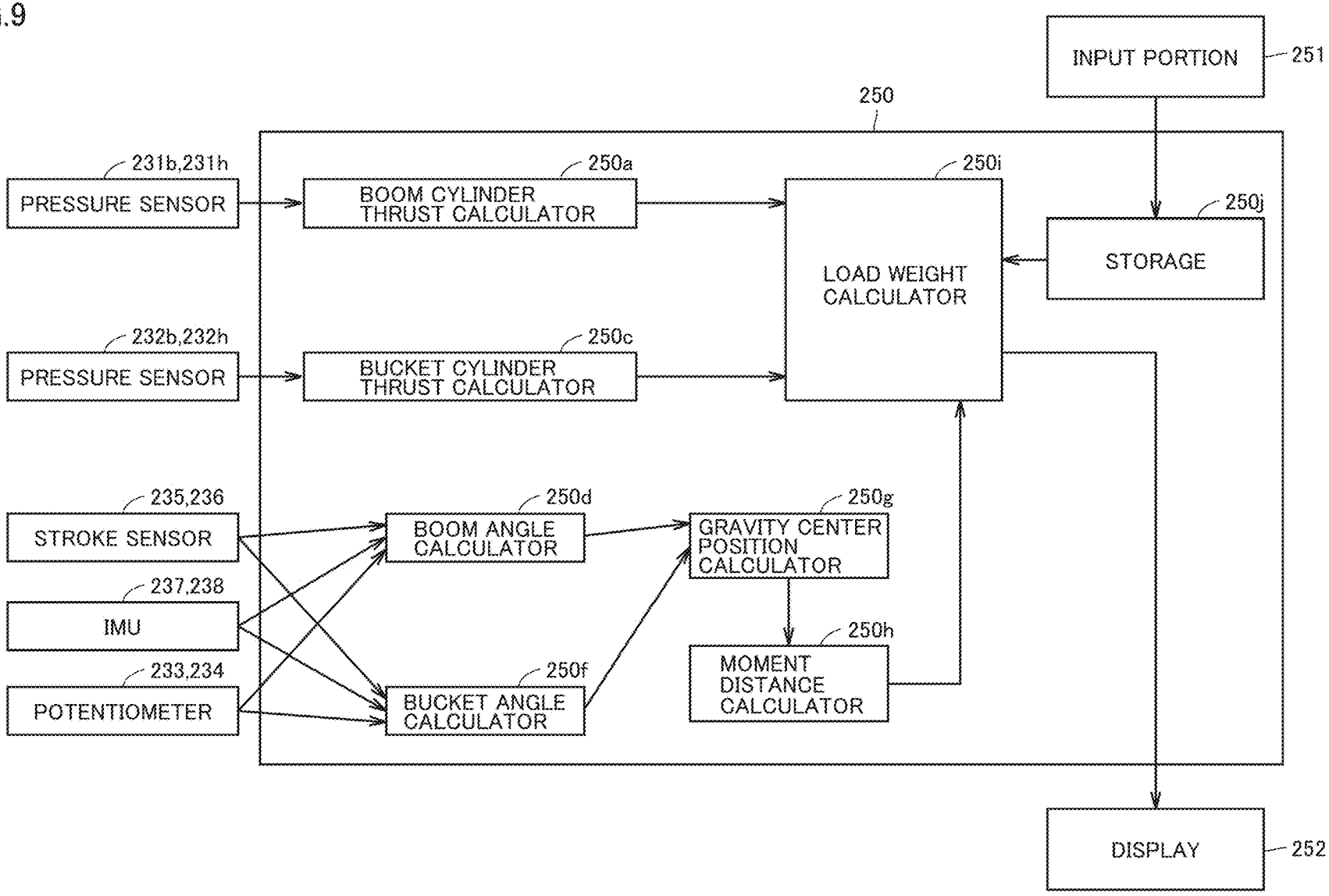
FIG. 9 is a diagram showing a functional block in a controller in the fourth embodiment.

FIG. 9 is a diagram showing a functional block in a controller 250 in the fourth embodiment. The system in the present embodiment is a system for determining a load weight which is a weight of a load conveyed by work implement 203. The system in the present embodiment includes wheel loader 200 representing an exemplary work machine shown in FIG. 8 and controller 250 shown in FIG. 9. Controller 250 may be mounted on wheel loader 200. Controller 250 may be provided outside wheel loader 200. Controller 250 may be arranged at a worksite of wheel loader 200 or at a remote location distant from the worksite of wheel loader 200.

As shown in FIG. 9, a boom cylinder thrust calculator 250*a* obtains a result of sensing by pressure sensors 231*b* and 231*h*. Specifically, boom cylinder thrust calculator 250*a* obtains the head pressure of boom cylinder 218 sensed by pressure sensor 231*h*. Boom cylinder thrust calculator 250*a* obtains the bottom pressure of boom cylinder 218 sensed by pressure sensor 231*b*. Boom cylinder thrust calculator 250*a* calculates boom cylinder thrust $F_{boom}$ based on the head pressure and the bottom pressure of boom cylinder 218.

Thrust is defined as force that moves an object in the direction of motion, and boom cylinder thrust $F_{boom}$ is thrust generated by boom cylinder 218 that rotates boom 215 relatively to the vehicular body. Boom cylinder thrust calculator 250*a* outputs calculated boom cylinder thrust $F_{boom}$ to a load weight calculator 250*i*.

A bucket cylinder thrust calculator 250*c* obtains a result of sensing by pressure sensors 232*b* and 232*h*. Specifically, bucket cylinder thrust calculator 250*c* obtains the head pressure of bucket cylinder 219 sensed by pressure sensor 232*h*. Bucket cylinder thrust calculator 250*c* obtains the bottom pressure of bucket cylinder 219 sensed by pressure sensor 232*b*. Bucket cylinder thrust calculator 250*c* calculates bucket cylinder thrust $F_{bucket}$ based on the head pressure and the bottom pressure of bucket cylinder 219.

Bucket cylinder thrust $F_{bucket}$ is thrust generated by bucket cylinder 219 that rotates bucket 214 relatively to boom 215. Bucket cylinder thrust calculator 250*c* outputs calculated bucket cylinder thrust $F_{bucket}$ to load weight calculator 250*i*.

A boom angle calculator 250*d* obtains information on a boom angle from at least one sensor of stroke sensor 235, IMU 237, and potentiometer 233. Boom angle calculator 250*d* calculates the boom angle based on the obtained information. Boom angle calculator 250*d* outputs the calculated boom angle to a gravity center position calculator 250*g*.

A bucket angle calculator 250*f* obtains information on a bucket angle from at least one sensor of stroke sensor 236, IMU 238, and potentiometer 234. Bucket angle calculator 250*f* calculates the bucket angle based on the obtained information. Bucket angle calculator 250*f* outputs the calculated bucket angle to gravity center position calculator 250*g*.

Various types of information such as a dimension and a weight of each member that makes up work implement 203 and a position of center of gravity GC1 of work implement 203 are stored in a storage 250*j*. Such various types of information may be inputted from an input portion 251 outside controller 250 into storage 250*j*. Storage 250*j* may be arranged outside controller 250, instead of being included in controller 250.

Gravity center position calculator 250*g* calculates a position of center of gravity GC1 of work implement 203 relative to boom bottom pin 221. Gravity center position calculator 250*g* calculates the relative position of center of gravity GC1 of work implement 203 based on the boom angle calculated by boom angle calculator 250*d*, the bucket angle calculated by bucket angle calculator 250*f*, and the position of center of gravity GC1 in work implement 203 stored in storage 10*j*.

A moment distance calculator 250*h* calculates a distance in the horizontal direction from boom bottom pin 221 to center of gravity GC1 of work implement 203. Specifically, moment distance calculator 250*h* calculates distance Xwe in the horizontal direction from boom bottom pin 221 to center of gravity GC1 of work implement 203.

Moment distance calculator 250*h* calculates distance Xbucket in the horizontal direction from boom bottom pin 221 to a center of gravity GC3 (FIG. 10) of bucket 214. Moment distance calculator 250*h* calculates a distance Xtiltrod in the horizontal direction from boom bottom pin 221 to the center of gravity of tilt rod 217.

Moment distance calculator 250*h* calculates a distance Xpin in the horizontal direction from boom bottom pin 221 to support pin 229.

Moment distance calculator 250*h* calculates distance $h_{boom}$ from boom bottom pin 221 to boom cylinder 218 in a direction orthogonal to the direction of extension of boom cylinder 218. Moment distance calculator 250*h* calculates distance $h_{bucket}$ from support pin 229 to bucket cylinder 219 in a direction orthogonal to the direction of extension of bucket cylinder 219.

Moment distance calculator 250*h* outputs these calculated distances to load weight calculator 250*i*.

Load weight calculator 250*i* calculates weight Mpayload of a load loaded in bucket 214. Load weight calculator 250*i* outputs calculated weight Mpayload to a display 252 outside controller 250. Display 252 may be arranged, for example, in cab 205 (FIG. 8) or at a remote location distant from wheel loader 200. Display 252 shows calculated weight Mpayload on a screen. An operator who operates wheel loader 200 in cab 205, an operator who operates wheel loader 200 at a remote location, or a monitoring person who monitors an operation of wheel loader 200 can recognize weight Mpayload of the load loaded in bucket 214 by looking at display 252.

Each of input portion 251 and display 252 may be connected to controller 250 through a wire or wirelessly.

Details of the method of calculating weight Mpayload of the load loaded in bucket 214 in the fourth embodiment will be described below. Load weight calculator 250*i* shown in FIG. 9 reads an equation of moment equilibrium around boom bottom pin 221 from storage 250*j*. The equation of moment equilibrium around boom bottom pin 221 is expressed in an equation (8) below.

[Equation 8]

$$F_{boom} \times h_{boom} = M_{payload} \times X_{payload} + MX_{we} \quad (8)$$

The left side of the equation (8) expresses the moment resulting from boom cylinder thrust $F_{boom}$. In the equation (8), Mpayload represents the weight of the load loaded in bucket 214. Xpayload represents the distance in the horizontal direction from boom bottom pin 221 to center of gravity GC2 of the load loaded in bucket 214. The first term in the right side of the equation (8) expresses the moment resulting from the load loaded in bucket 214.

$MX_{we}$ in the second term in the right side of the equation (8) represents the moment resulting from the self-weight of work implement 203. Moment $MX_{we}$ is calculated as a product of a sum M1 (FIG. 8) of weights of members that make up work implement 203 and distance Xwe in the horizontal direction from boom bottom pin 221 to center of gravity GC1 of work implement 203.

Load weight calculator 250*i* then reads the equation of moment equilibrium around support pin 229 from storage 250*j*. FIG. 10 is a schematic diagram showing moment equilibrium around support pin 229. The equation of moment equilibrium around support pin 229 is expressed in an equation (9) below.

[Equation 9]

$$F_{bucket} \times h_{bucket} = M_{payload} \times (X_{payload} - X_{pin}) + MX_{we_pin} \quad (9)$$

The left side of the equation (9) represents the moment resulting from bucket cylinder thrust $F_{bucket}$. The first term in the right side of the equation (9) represents the moment resulting from the load loaded in bucket 214. $MX_{we}$_pin in the second term in the right side of the equation (9) represents the moment resulting from the self-weight of work implement 203 on the tip end side of work implement 203 relative to support pin 229. Moment $MX_{we}$_pin is calculated in an equation (10) below.

[Equation 10]

$$MX_{we_pin} = M_{bucket} \times (X_{bucket} - X_{pin}) + M_{tiltrod} \times (X_{tiltrod} - X_{pin}) \quad (10)$$

In the equation (10), $M_{bucket}$ represents the weight of bucket 214. Mtiltrod represents the weight of tilt rod 217. Each of these weights $M_{bucket}$ and Mtiltrod is stored in storage 250*j*, for example, by an operation for input into storage 250*j* through input portion 251 shown in FIG. 9.

Based on the simultaneous equations of the equation (8) and the equation (9), an equation (11) below not dependent on distance Xpayload can be established as an equation for calculating load weight Mpayload.

[Equation 11]

$$M_{payload} = \frac{F_{boom} \times h_{boom} - F_{bucket} \times h_{bucket} - MX_{we} + MX_{we_pin}}{X_{pin}} \quad (11)$$

The equation (8) includes distance Xpayload and the equation (9) also includes distance Xpayload. By solving the two equilibrium equations as the simultaneous equations, the equation (11) not including distance Xpayload is derived. Load weight Mpayload can be calculated based on the equation (11). More accurate load weight Mpayload can thus be calculated without being affected by displacement of the position of the center of gravity of the load loaded in bucket 214.

By substituting load weight Mpayload calculated in accordance with the equation (11) into the equation (8) or the equation (9), distance Xpayload can be calculated. An equation not dependent on load weight Mpayload can be established as an equation for calculating distance Xpayload from the simultaneous equations of the equation (8) and the equation (9). The position of the center of gravity of the load loaded in bucket 214 can be corrected in accordance with calculated distance Xpayload.

In wheel loader 200 shown in the fourth embodiment, by calculating the weight of the load during loaded rearward travel in which wheel loader 200 travels rearward while the load is loaded in bucket 214, the weight of the load can more accurately be calculated.

In the embodiments, controller 10 uses two equilibrium equations of moment equilibrium equations for a plurality of links provided in the work implement, as the relational expressions for calculation of the weight of the load. The relational expression is not limited to the moment equilibrium equation, and a motion equation for each of the plurality of links may be employed. The motion equation may be set up based on information from the pressure sensor and the position sensor as in the case of the equilibrium equation.

Though embodiments have been described as above, it should be understood that the embodiments disclosed herein are illustrative and non-restrictive in every respect. The scope of the present invention is defined by the terms of the claims rather than the description above and is intended to include any modifications within the scope and meaning equivalent to the terms of the claims.

REFERENCE SIGNS LIST

1 traveling unit; 2 revolving unit; 2*a* operator's cab; 3, 203 work implement; 3*a*, 215 boom; 3*b* arm; 3*c*, 214 bucket (attachment); 3*d* bucket link; 3*da* first link member; 3*db* second link member; 3*dc* bucket cylinder top pin; 3*dd* first link pin; 3*de* second link pin; 4*a*, 218 boom cylinder (boom hydraulic cylinder); 4*aa* cylinder; 4*ab* cylinder rod; 4*b* arm cylinder (arm hydraulic cylinder); 4*c*, 219 bucket cylinder (attachment hydraulic cylinder); 5*a*, 221 boom bottom pin (first center of rotation); 5*b*, 222 boom top pin (second center of rotation); 5*c* arm top pin (third center of rotation); 6*a*, 6*b*, 6*c*, 6*d*, 6*e*, 6*f*, 231*b*, 231*h*, 232*b*, 232*h* pressure sensor; 7*a*, 7*b*, 7*c*, 235, 236 stroke sensor; 9*a*, 9*b*, 9*c* angle sensor (sensor, position sensor); 10, 250 controller; 10*a*, 250*a* boom cylinder thrust calculator; 10*b* arm cylinder thrust calculator; 10*c*, 250*c* bucket cylinder thrust calculator; 10*d*, 250*d* boom angle calculator; 10*e* arm angle calculator; 10*f*, 250*f* bucket angle calculator; 10*g*, 250*g* gravity center position calculator; 10*h*, 250*h* moment distance calculator; 10*i*, 250*i* load weight calculator; 10*j*, 250*j* storage; 11, 251 input portion; 12, 252 display; 40 actuator; 100 hydraulic excavator; 103 lifting magnet; 104 support portion; 105 main body portion; 200 wheel loader; 202 vehicular body frame; 204 traveling apparatus; 205 cab; 216 bell crank; 217 tilt rod; 229 support pin; 233, 234 potentiometer; L load

The invention claimed is:

1. A computing device of a work machine including a work implement, the computing device calculating a weight of a load conveyed by the work implement, the work machine including a vehicular body, a boom bottom pin supported by the vehicular body, a boom rotatably coupled to the vehicular body by the boom bottom pin, a boom top pin attached to a tip end of the boom, an arm rotatably coupled to the boom by the boom top pin, an arm top pin attached to a tip end of the arm, and an attachment rotatably coupled to the arm by the arm top pin, wherein the computing device calculates the weight of the load based on any two equilibrium equations of an equation of moment equilibrium around the boom bottom pin, an equation of moment equilibrium around the boom top pin, and an equation of moment equilibrium around the arm top pin.

2. The computing device according to claim 1, wherein the work machine includes an actuator that generates thrust that rotates the boom relatively to the vehicular body, and a sensor that senses an angle of the boom with respect to the vehicular body, and the computing device establishes the equation of moment equilibrium around the boom bottom pin based on the thrust generated by the actuator and a result of sensing by the sensor.

3. The computing device according to claim 1, wherein the work machine includes an actuator that generates thrust that rotates the arm relatively to the boom, and a sensor that senses an angle of the arm with respect to the boom, and the computing device establishes the equation of moment equilibrium around the boom top pin based on the thrust generated by the actuator and a result of sensing by the sensor.

4. The computing device according to claim 1, wherein the work machine includes an actuator that generates thrust that rotates the attachment relatively to the arm, and a sensor that senses an angle of the attachment with respect to the arm, and the computing device establishes the equation of moment equilibrium around the arm top pin based on the thrust generated by the actuator and a result of sensing by the sensor.

5. The computing device according to claim 4, wherein the work machine further includes a link member that couples the actuator and the arm to each other, and the sensor is attached to the link member.

6. The computing device according to claim 1, wherein the attachment is a lifting magnet.

7. The computing device according to claim 1, wherein the computing device calculates a position of a center of gravity of the load based on the any two equilibrium equations.

8. A computing device of a work machine including a work implement, the computing device calculating a weight of a load conveyed by the work implement, the work machine including a vehicular body, a boom bottom pin supported by the vehicular body, a boom rotatably coupled to the vehicular body by the boom bottom pin, a boom top pin attached to a tip end of the boom, an attachment rotatably coupled to the boom by the boom top pin, and a pivot member supported by the boom and being rotatable together with the attachment with respect to the boom, wherein the computing device calculates the weight of the load based on two equilibrium equations of an equation of moment equilibrium around the boom bottom pin and an equation of moment equilibrium around a center of rotation of the pivot member.

9. The computing device according to claim 8, wherein the work machine includes an actuator that generates thrust that rotates the boom relatively to the vehicular body, and a sensor that senses an angle of the boom with respect to the vehicular body, and the computing device establishes the equation of moment equilibrium around the boom bottom pin based on the thrust generated by the actuator and a result of sensing by the sensor.

10. The computing device according to claim 8, wherein the work machine includes an actuator that generates thrust that rotates the attachment relatively to the boom, and a sensor that senses an angle of the attachment with respect to the boom, and the computing device establishes an equation of moment equilibrium around the center of rotation based on the thrust generated by the actuator and a result of sensing by the sensor.

11. The computing device according to claim 8, wherein the computing device calculates a position of a center of gravity of the load based on the two equilibrium equations.

12. A computing device of a work machine including a work implement, the computing device calculating a weight of a load conveyed by the work implement, the work machine including a vehicular body, a boom bottom pin supported by the vehicular body, a boom having one end rotatably coupled to the vehicular body by the boom bottom pin, a boom top pin attached to the other end of the boom, an arm having one end rotatably coupled to the other end of the boom by the boom top pin, an arm top pin attached to the other end of the arm, an attachment having one end rotatably coupled to the other end of the arm by the arm top pin, a boom hydraulic cylinder that drives the boom to rotationally operate, an arm hydraulic cylinder that drives the arm to rotationally operate, an attachment hydraulic cylinder that drives the attachment to rotationally operate, a pressure sensor including at least two sensors of a boom pressure sensor that is attached to the boom hydraulic cylinder and outputs hydraulic oil pressure information of the boom hydraulic cylinder, an arm pressure sensor that is attached to the arm hydraulic cylinder and outputs hydraulic oil pressure information of the arm hydraulic cylinder, and an attachment pressure sensor that is attached to the attachment hydraulic cylinder and outputs hydraulic oil pressure information of the attachment hydraulic cylinder, and a boom position sensor that outputs boom information for obtaining a position of the boom with respect to the vehicular body, an arm position sensor that outputs arm information for obtaining a position of the arm with respect to the boom, and an attachment position sensor that outputs attachment information for obtaining a position of the attachment with respect to the arm, wherein the computing device calculates the weight of the load in conveyance of the load based on any two relational expressions of a first relational expression generated from the hydraulic oil pressure information of the boom hydraulic cylinder and the boom information, a second relational expression generated from the hydraulic oil pressure information of the arm hydraulic cylinder and the arm information, and a third relational expression generated from the hydraulic oil pressure information of the attachment hydraulic cylinder and the attachment information, and the pressure sensor includes at least two sensors corresponding to the two relational expressions.

13. The computing device according to claim 12, wherein the boom position sensor is a sensor that senses an angle of the boom with respect to the vehicular body, the arm position sensor is a sensor that senses an angle of the arm with respect to the boom, and the attachment position sensor is a sensor that senses an angle of the attachment with respect to the arm.

14. The computing device according to claim 12, wherein the first relational expression is an equation of moment equilibrium around the boom bottom pin in conveyance of the load, the second relational expression is an equation of moment equilibrium around the boom top pin in conveyance of the load, and the third relational expression is an equation of moment equilibrium around the arm top pin in conveyance of the load.

15. A computing method of calculating a weight of a load conveyed by a work implement, for a work machine including the work implement, the work implement including as members, a boom that pivots around a first center of rotation, an arm that pivots around a second center of rotation, and an attachment that pivots around a third center of rotation, the computing method comprising:

establishing, for the members, relational expressions of a motion around any two centers of rotation of the first center of rotation, the second center of rotation, and the third center of rotation;

obtaining a weight and a position of a center of gravity of each of the members;

obtaining positions of the members in conveyance of the load;

obtaining thrust corresponding to the motion in the relational expressions;

computing horizontal distances between the positions of the centers of gravity of the members in conveyance of the load and corresponding ones of the first center of rotation, the second center of rotation, and the third center of rotation based on the positions of the centers of gravity and the positions of the members, respectively; and computing the weight of the load conveyed by the work implement based on the relational expressions, the obtained information, and the computed information.

16. The computing method according to claim 15, wherein the positions of the members are obtained based on angles indicating attitudes of the members.

17. The computing method according to claim 15, wherein the relational expressions are equations of moment equilibrium around the centers of rotation of the motion.

* * * * *